US005992514A

United States Patent [19]

Sugimoto et al.

[11] Patent Number: 5,992,514

[45] Date of Patent: Nov. 30, 1999

[54] HEAT EXCHANGER HAVING SEVERAL EXCHANGING PORTIONS

[75] Inventors: Tatsuo Sugimoto, Okazaki; Shinobu Suzuki, Kariya; Takaaki Sakane, Nagoya; Yasutoshi Yamanaka, Kariya; Akira Uchikawa, Nagoya; Hiroo Yamaguchi, Toyohashi, all of Japan

[73] Assignee: Denso Corporation, Kariya, Japan

[21] Appl. No.: 09/024,097

[22] Filed: Feb. 17, 1998

Related U.S. Application Data

[63] Continuation-in-part of application No. 08/746,461, Nov. 12, 1997, abandoned.

[30] Foreign Application Priority Data

| | | | |
|---|---|---|---|
| Nov. 13, 1995 | [JP] | Japan | 7-294528 |
| Dec. 15, 1995 | [JP] | Japan | 7-327604 |
| Jun. 7, 1996 | [JP] | Japan | 8-146082 |
| Feb. 19, 1997 | [JP] | Japan | 9-035162 |

[51] Int. Cl.[6] ..... F28F 13/00

[52] U.S. Cl. ..... 165/135; 165/140; 165/149

[58] Field of Search ..... 165/140, 135, 165/153, 149, 146

[56] References Cited

U.S. PATENT DOCUMENTS

| | | | |
|---|---|---|---|
| 4,332,293 | 6/1982 | Hiramatsu | 165/153 |
| 5,000,257 | 3/1991 | Shinmura | 165/140 |
| 5,033,540 | 7/1991 | Tategami et al. | 165/135 |
| 5,720,341 | 2/1998 | Watanabe et al. | 165/135 |

FOREIGN PATENT DOCUMENTS

| | | | |
|---|---|---|---|
| 0 030 072 | 6/1981 | European Pat. Off. . | |
| 108394 | 6/1983 | Japan | 165/135 |

*Primary Examiner*—Leonard Leo
*Attorney, Agent, or Firm*—Harness, Dickey & Pierce, PLC

[57] ABSTRACT

A first cooling fin and a second cooing fin are separated to have a predetermine clearance, and a plurality of connecting portions for partly connecting the first and second cooling fins are formed. When the first and second cooling fins are unfolded, the length E of each the connecting portion in parallel with the longitudinal direction of the first and second cooling fins is equal to 5% or less of the length F between the adjacent connecting portions. Further, the first cooling fin is projected from the condenser tube toward the radiator tube side with a projection length Lc being in a range of 1.7 to 7.0 mm.

50 Claims, 15 Drawing Sheets

HEAT EXCHANGER HAVING SEVERAL EXCHANGING PORTIONS

This is a continuation-in-part of U.S. patent application Ser. No. 08/746,461, filed Nov. 12, 1997 now abandoned.

CROSS-REFERENCE TO RELATED APPLICATION

This application is related to and claims priority from Japanese Patent Applications Nos. Hei. 7-294528 filed on Nov. 13, 1995, Hei. 7-327604 filed on Dec. 15, 1995, Hei. 8-146082 filed on Jun. 7, 1996, and Hei. 9-35162 filed on Feb. 19, 1997, the contents of which are hereby incorporated by reference.

BACKGROUND OF THE INVENTION

1. Field of the Invention

The present invention relates to a heat exchanger in which different core portions are integrated with each other, and more particularly the present invention can be effectively applied to an integration of a radiator of an engine which is a driving source of a vehicle and a condenser of an automotive air conditioning apparatus.

2. Description of Related Art

Conventionally, an automotive air conditioning apparatus is assembled into a vehicle in a car dealer or the like after the vehicle has been completed. Recently, however, the automotive air conditioning apparatus is generally installed in the vehicle when the vehicle is completed, and therefore the automotive air conditioning apparatus is assembled with automotive parts in the assembling steps of the vehicle at the manufacturing plant.

There have been proposed a plurality of heat exchangers in which different core portions such as a radiator and a condenser are integrated. By integrating the radiator which is an automotive part and the condenser which is an automotive air conditioning apparatus part with each other, the heat exchanger is downsized and the assembling steps can be decreased.

However, because the different core parts are integrated with each other, heat transmission is generated through the integrated part so that there is a problem in that the heat exchange efficiency of the core portion to which heat is transmitted is decreased. That is, when the radiator and the condenser are integrated with each other, heat is transmitted from the radiator to the condenser so that the heat exchange efficiency of the condenser is decreased.

To suppress the heat transmitting amount, as disclosed in JP-A-3-177795, for example, cooling fins of first core portion and second core portion are integrated with each other, and a slit shaped recess portion is formed in a zigzag shape in a height direction of the integrated cooling, and a heat transmitting passage for transmitting heat is meanderingly formed so as to prolong the heat transmitting passage.

In the above-described heat exchanger, the heat transmitting passage is prolonged so that heat transmitted from the radiator to the condenser is suppressed, however, the heat transmission cannot be interrupted completely. Thus, to maintain a desired heat exchange amount in the condenser core portion, it is necessary to decide the capacity of the condenser core portion by considering the decrease of the heat exchange efficiency.

That is, when designing a heat exchanger in which different core portions are integrated with each other, it is necessary for a core portion to which heat is transmitted (condenser core portion) to be made larger by considering the decrease of the heat exchange efficiency in the core portion to which the heat is transmitted (condenser core portion).

However, if only the heat transmitting passage is simply made larger, the principal object for a small-sized heat exchanger in which different core portions are integrated with each other cannot be achieved.

SUMMARY OF THE INVENTION

In view of the foregoing problems, it is an object of the present invention to provide a heat exchanger in which different core portions are integrated with each other, while preventing the heat exchanger from being large-sized and the heat exchange efficiency from being lowered.

According to an aspect of the present invention, a plurality of folded portions of corrugated first and second cooling fins are formed between a pair of adjacent connecting portions for connecting the first and second cooling fins. The connecting portions may be formed in each flat portion of the first and second cooling fins. Therefore, total cross sectional areas of the plurality of connecting portions which is a cross sectional area of heat transmitting passage of heat transmitted between the two cooling fins can be reduced. Thus, the heat transmitting amount between the two cooling fins can be reduced, so that the heat transmitting between the two cooling fins can be effectively interrupted.

Further, the cross sectional area of the heat transmitting passage is reduced so that the heat transmitting between the two cooling fins is interrupted. As compared with the conventional heat exchanger in which the heat transmitting between the two cooling fins is interrupted by increasing the heat transmitting passage, the distance between the two cooling fins can be suppressed from increasing. Thus, the heat exchanger can be suppressed from being large-sized, and the heat transmitting between the two cooling fins can be effectively interrupted.

According to another aspect of present invention, a recess portion is formed on the cooling fins so as to cross over folded portions of the cooling fins. Further, the connecting portion has a portion in parallel with a longitudinal direction of the first and second cooling fins, and a length (E) of the portion being equal to 5% or less of a length (F) between each pair of the adjacent connecting portions when the first and second cooling fins are unfolded. Therefore, the deterioration percentages of the heat exchange efficiency of the first cooling fin can be suppressed less than 2%. Further, the first cooling fin is projected from the first tubes to the second tubes side with a projection length being in a range of 1.7–7.0 mm. Therefore, radiating amount of the first tube and the first cooling fin can be increased over about 2%. Thus, by suitably selecting the projection length Lc of the first cooling fin and the connection ratio (E/F), the deterioration amount with providing the connecting portion can be offset by the increase of the radiating amount with projecting the first cooling fin.

According to still another aspect of the present invention, the second cooling fin is projected from the second tube toward the first tube side, the projection length (Lr) is equal to 5.0 mm or less. Therefore, the size of the heat exchanger can be prevented from being large-sized, and the heat exchange efficiency can be prevented from decreasing. Further, because the cooling fins are integrally formed through the connecting portions, the manufacturing cost of the two cooling fins can be reduced so that the manufacturing cost of the heat exchanger can be reduced.

According to still another aspect of the present invention, a partition member is located at end portions of the first core portion and second core portion. By the partition member, air bypassing the first core portion does not flow through the clearance between the first cooling fin and the second cool fin, so that a duct effect can be obtained.

According to further another aspect of the present invention, the distance between the first cooling fin and the second cooling fin is equal to 5.0 mm or less. Therefore, the air flow resistance becomes larger, so that the duct effect can be obtained.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

A first embodiment of the present invention will be described.

In an automotive heat exchanger of the first embodiment of the present invention, a condenser core portion of an automotive air conditioning apparatus is used as a first core portion, a radiator core portion for cooling an engine is used as a second core portion. Generally, because the temperature of refrigerant flowing through the condenser core portion is lower than that of an engine cooling water flowing through the radiator, the condenser core portion is disposed at an upstream air side of the radiator core portion in air flow direction and the two core portions are disposed in series in the air flow direction at a front-most portion of an engine compartment.

The structure of the heat exchanger of the first embodiment is hereinafter described with reference to FIGS. 1 through 8.

Figure 1:
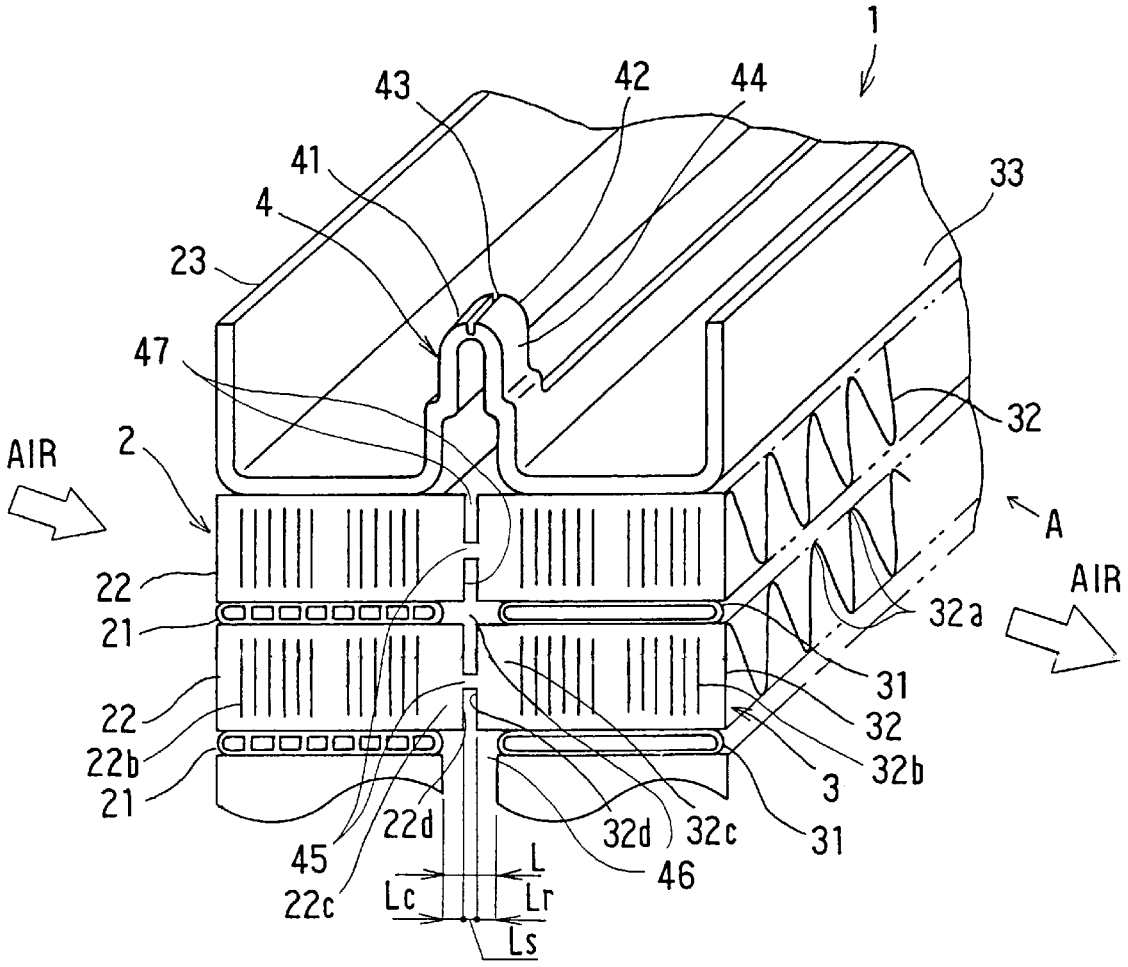
FIG. 1 is a perspective view showing a core portion of a heat exchanger (a cross-section taken along line B—B of FIG. 2) according to a first embodiment of the present invention.

FIG. 1 is a partial enlarged cross-sectional view (along line B—B of FIG. 2) of a heat exchanger 1 of the present invention.

As shown in FIG. 1, a condenser core portion 2 and a radiator core portion 3 are disposed in series in the air flow direction so as to form predetermined clearances 46 between each pair of a condenser tube 21 and a radiator tube 31 described later to interrupt heat transmission.

The condenser core portion 2 includes flat shaped condenser tubes 21 which are refrigerant passages and corrugated (wave-shaped) cooling fins 22 in which a plurality of folded portions 22*a* brazed to the condenser tube 21 are formed.

The radiator core portion 3 has a similar structure with the condenser core portion 2. The radiator core portion 3 includes the radiator tubes 31 disposed in parallel with the condenser tubes 21 and radiator cooling fins 32. The tubes 21 and 31 and the cooling fins 22 and 32 are alternately laminated and are brazed to each other. A plurality of louvers 22*b* and 32*b* are formed in the two cooling fins 22 and 32 to facilitate heat exchange, the two cooling fins 22 and 23 are integrally formed with the louvers 22*b* and 32*b* by a roller forming method or the like.

Figure 7:
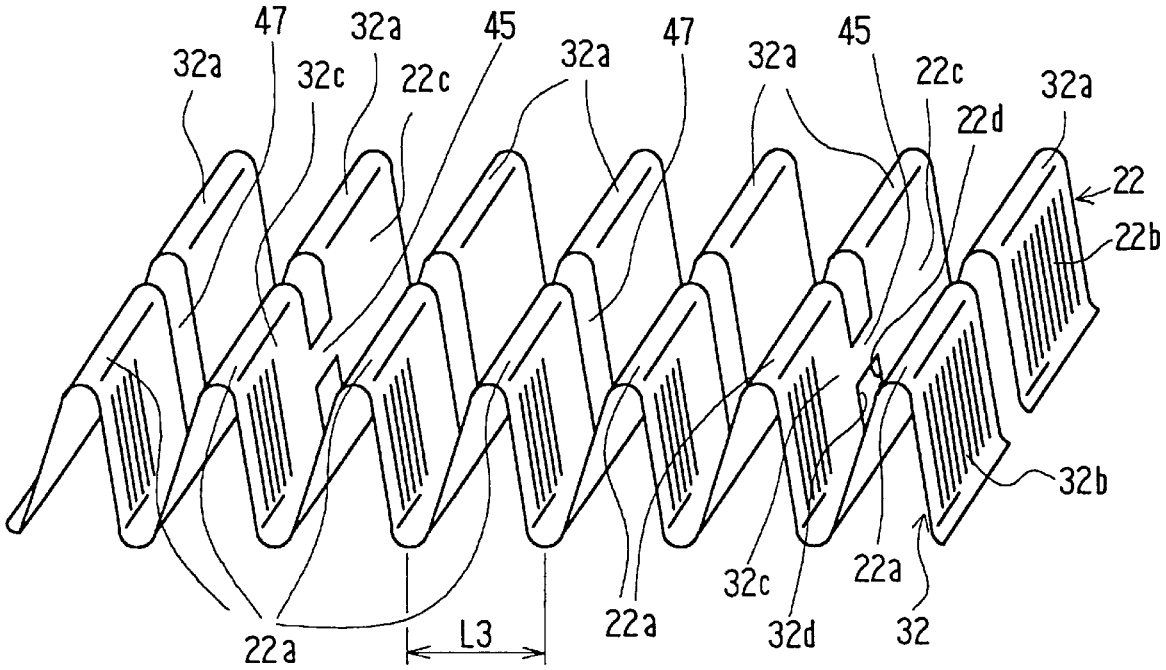
FIG. 7 is a perspective view showing a shape of the cooling fin.

A plurality of connecting portions 45 are formed between the two cooling fins 22 and 32. By way of the plurality of connecting portions 45, opposite end portions 22*d* and 32*d* which Do are vertical to the longitudinal direction of the two tubes 21 and 31 formed end portions of the two cooling fins 22 and 32 are connected to each other. As shown in FIG. 7, a plurality of folded portions 22*a* and 32*a* (five to ten folded portions in the first embodiment) of the two cooling fins 22 and 32 are a formed between one of the plurality of connecting portions 45 and the other connecting portion 45.

Figure 8:
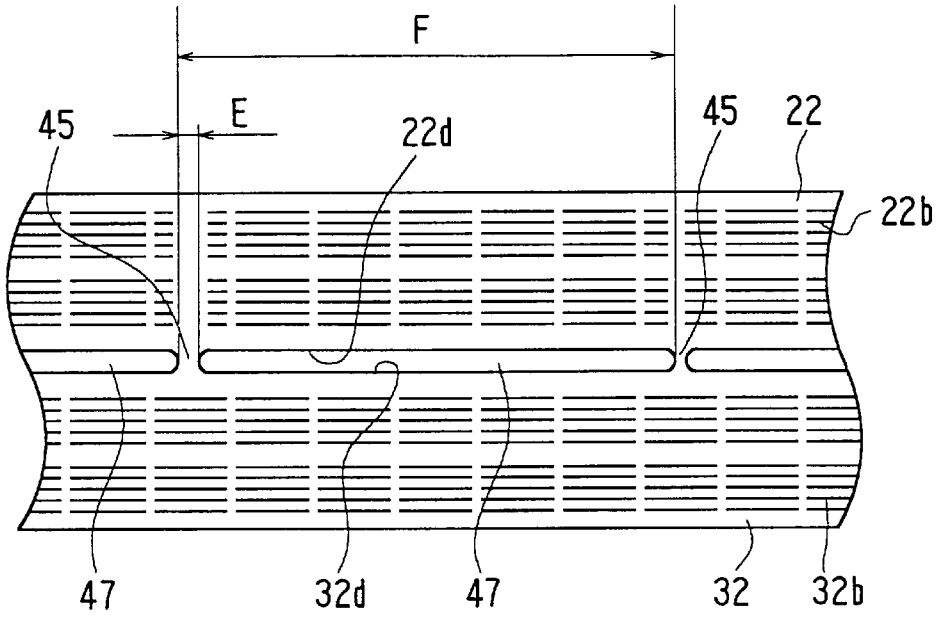
FIG. 8 is a plan view showing the cooling fin.

When the two cooling fins 22 and 23 (in FIG. 7) are unfolded as shown in FIG. 8, the connecting portions 45 and opening portions 47 are alternately formed in series in the longitudinal direction, and the cooling fins 22 and 23 are formed with the louvers 22*b* and 23*b* and the folded portions 22*a* and 32*a* by a roller process. In FIG. 8, E shows a length of each connecting portion 45 which is parallel to the longitudinal direction of the two cooling fins 22 and 23, F shows a length between two adjacent connecting portions 45 of the plurality of connecting portions 45. The length E is equal to five percentages of the length F or less. The ratio between the length E and the length F (hereinafter referred to as a connection ratio E/F) will be described later.

Because the folded portions 22*a* and 32*a* of the two cooling portions 22 and 23 contact with the two tubes 21 and 31, most of heat transmitted to the two cooling fins 22 and 32 are transmitted to the folded portions 22*a* and 32*a*. Thus, preferably, the connecting portions 45 are formed on plane portions 22*c* and 32*c* of the two cooling fins 22 and 32 as shown in FIGS. 1 and 7.

Further, because the width dimensions of the two cooling fins 22 and 32 which are vertical to the longitudinal direction of the two tubes 21 and 31 are larger than the flat width dimensions of two tubes 21 and 31, the two cooling fins 22 and 32 are projected toward the clearance 46 as shown in FIG. 1. A projection length Lc projected from the condenser tube 21 toward the clearance 46 and a projection length Lr projected from the radiator tube 31 toward the clearance 46 will be described later.

Figure 2:
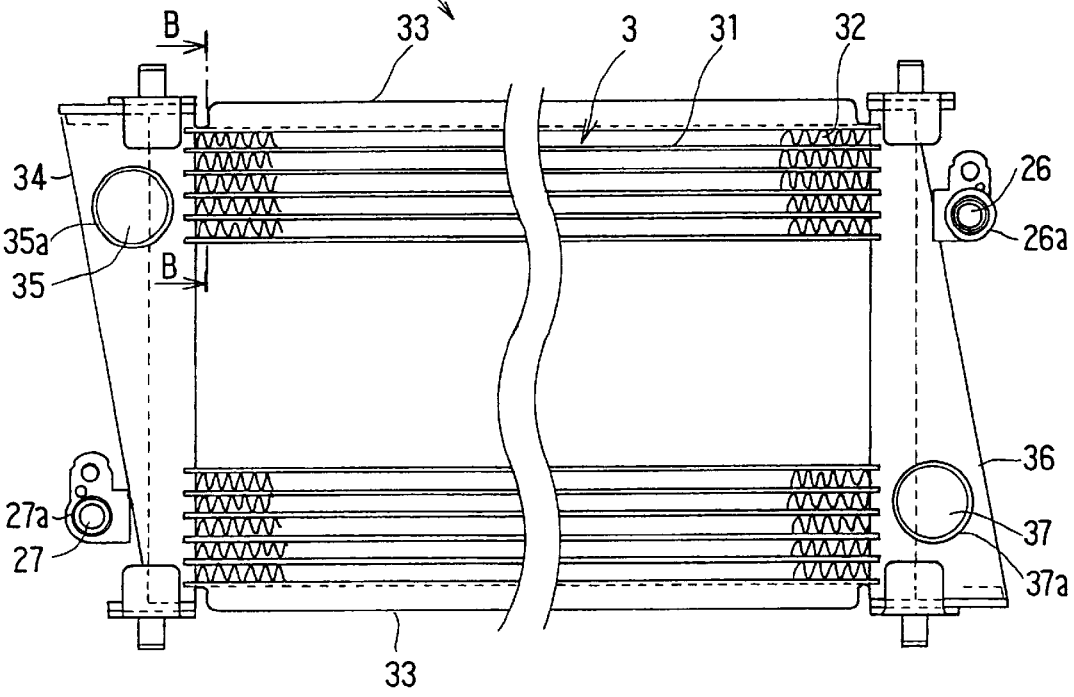
FIG. 2 is a perspective view taken from arrow B of FIG. 1.

Side plates 23 and 33 are reinforcement member of the two heat exchanger core portions 2 and 3, the side plates 23 and 33 are respectively disposed in two end portions of the two heat exchanger core portions as shown in FIG. 2. As shown in FIG. 1, the side plates 23 and 33 are integrally formed from a sheet of aluminum plate to a general U-shape in cross-sections. A connecting portion 4 for connecting the side plate 23 and the side plate 33 is formed in two end portions of the longitudinal direction of the two side plates 23 and 33. A Z-shaped bent portion 41 of the side plate 23 and a Z-shaped bent portion 42 of the side plate 33 are connected to each other at a top end portion 43 so that the connecting portion 4 is formed. The width of the connecting portion 4 is set to be small enough as compared with the dimension of the side plate 23 or 33 in the longitudinal direction. Further, a recess portion is formed in the top end portion 43 of the connecting portion 4 to reduce a thickness of the plate wall of the connecting portion 4.

Figure 3:
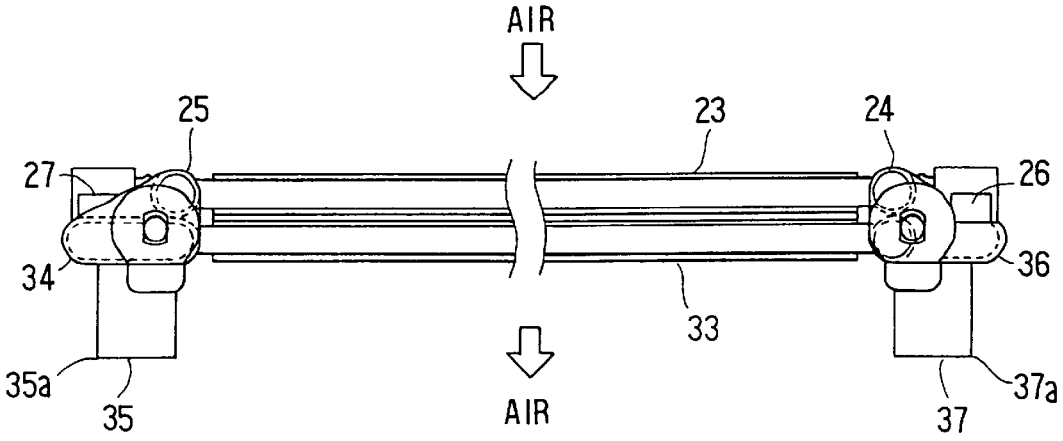
FIG. 3 is a perspective view taken from arrow C of FIG. 2.

Further, as shown in FIG. 2, a first header tank 34 for distributing cooling water to each the radiator tube 31 is disposed at an end side without having the side plate 33. The front shape of first header tank 34 is nearly a triangular, the cross-sectional shape is ellipsoid as shown in FIG. 3. The large-diameter of the ellipsoid becomes smaller along the oblique line of the triangular, further, becomes equal (a circle) to the small-diameter of the ellipsoid at the top side of the oblique line. An inlet 35 of cooling water flowing to the radiator is formed at a top side of the first header tank 34 having a nearly triangular. Further, a pipe 35*a* for connecting a pipe (not shown) of cooling water is brazed to the inlet 35.

Further, second header tank 36 for receiving the cooling water having been heat-exchanged is disposed in an opposite end of the first header tank 34, the second header tank 36 has a similar shape with the first header tank 34. As shown in FIG. 2, the second header tank 36 and the first header tank 34 are point-symmetrical with reference to the center of the radiator core portion 3. Further, an outlet 37 for discharging the cooling water is formed at the bottom side of the second header tank 36. With the tubes and the cooling fins and the like, a pipe 37*a* for connecting the pipe (not shown) of cooling water is brazed to the outlet 37. As shown in FIG. 2, the inlet 35 and the outlet 37 of the radiator are directed toward the paper side in FIG. 2.

The first header tank 24 distributes refrigerant in the condenser core portion 2 into each the condenser tube 21, and the body of the first header tank 24 is cylindrically formed as shown in FIG. 3. The first header tank 24 of the condenser is disposed to have a predetermined clearance with the second header tank 36 of the radiator. Further, a joint 26*a* for connecting a refrigerant pipe (not shown) is brazed to the body of the first header tank 24, and an inlet 26 of refrigerant is formed in the joint 26*a*.

Further, as shown in FIG. 3, a second header tank 25 of the condenser for receiving the refrigerant having been heat-exchanged is disposed in an opposite end of the first header tank 24 of the condenser, the second header tank 25 is disposed to have a predetermined clearance with the first header tank 34 of the radiator. The body of the second header tank is cylindrically formed. Further, as shown in FIG. 2, a joint 27*a* for connecting a refrigerant pipe (not shown) is brazed to the body of the second header tank 25, an outlet 27 of refrigerant is formed in the joint 27*a*. As shown in FIG. 2, the inlet 27 and the outlet 26 of the condenser are directed toward the paper side in FIG. 2.

Next, projection lengths Lc and Lr of the two cooling fins 22 and 23 will be described.

Figure 4:
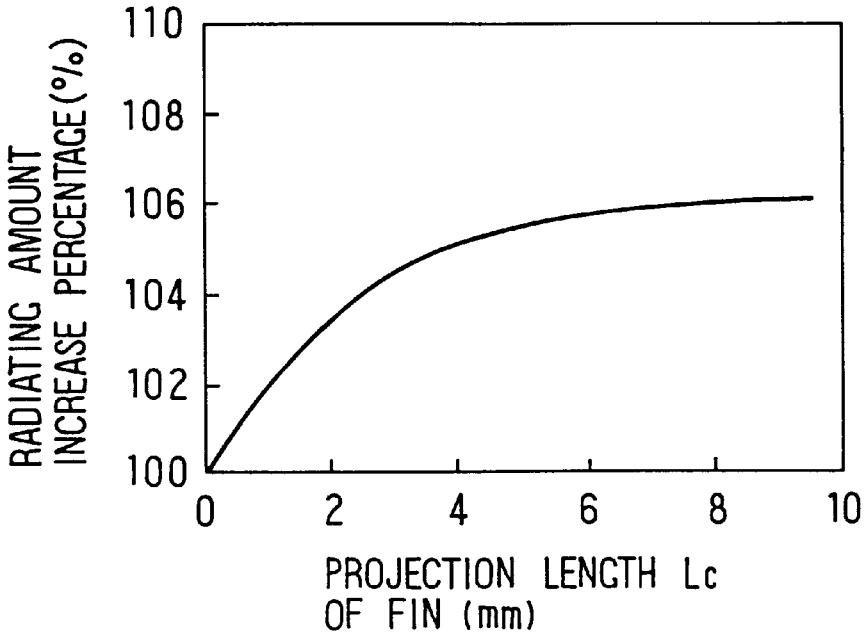
FIG. 4 is a graph showing a relationship between an increase percentage of radiating amount of a cooling fin in a condenser and a projection length of the cooling fin.
Figure 10:
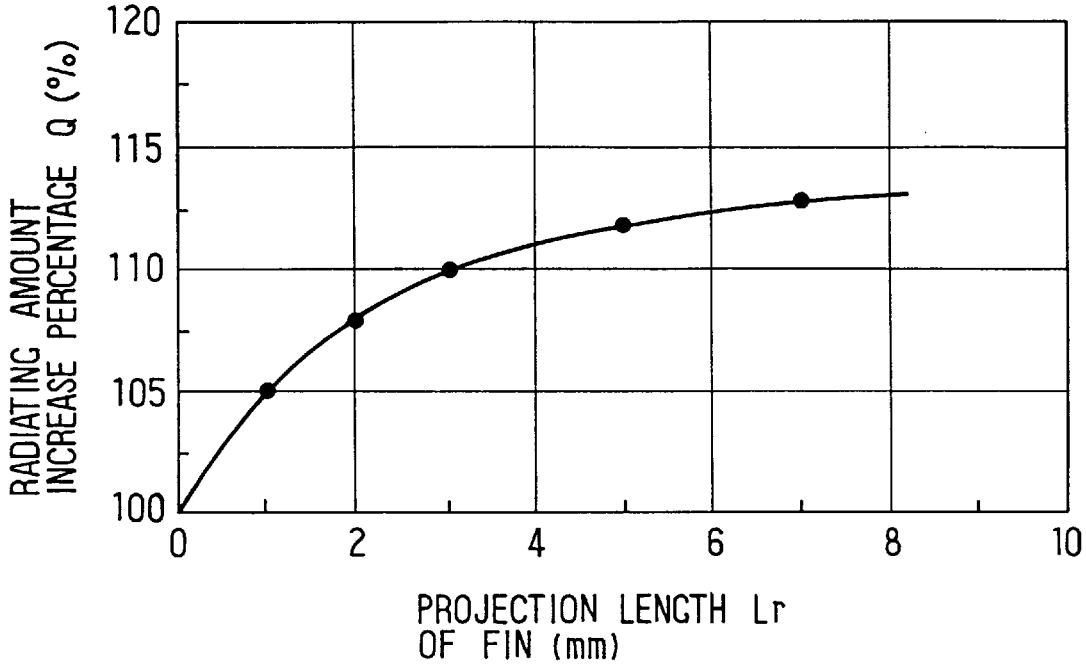
FIG. 10 is a graph showing the relations between an increase percentage of radiating amount of a cooling fin in a radiator core portion and a projection length of the cooling fin.

When the projection lengths Lc and Lr become larger, the radiating area of the two cooling fins 22 and 32 becomes larger so that radiating amount becomes larger. However, the closer it comes to the top end of the two cooling fins 22 and 32 from the two tubes 21 and 31, the smaller the difference of temperature between the two cooling fins 22 and 32 and air becomes. Thus, the radiating amount is not increased so much with increasing the projection lengths Lc and Lr. That is, as shown in FIG. 4, in the condenser core portion 2, when the projection length Lc of the cooling fin 22 is equal to 4.0 mm or more, the increase percentage of the radiating amount is saturated. On the other hand, as shown in FIG. 10, in the radiator core portion 3, when the projection length Lr of the cooling fin 32 is equal to 7.0 mm or more, the increase percentage of the radiating amount is saturated.

Figure 5:
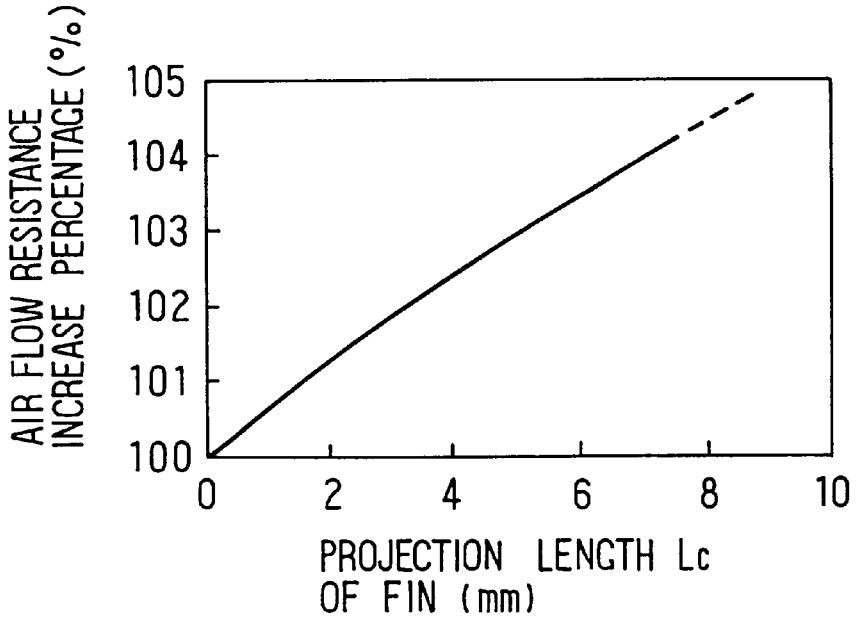
FIG. 5 is a graph showing a relationship between an increase percentage of an air flow resistance of air passing through the cooling fin of the condenser and a projection length of the cooling fin.

Further, as shown in FIG. 5, with increasing the projection lengths Lc and Lr, the resistance of air passing through the two core portions 2 and 3 is nearly linearly increased.

The above-described examinations shows numerical analytic results in a corrugated cooling fin having the louvers by a finite element method when a pitch of the louver is 1.0 mm, an angle of the louver is 23°, a height of the cooling fin is 8.0 mm, the clearance distance L formed between the two tubes 21 and 31 is 10.0 mm and the fixed speed of air flowing from a side of the condenser core portion 2 is 2.0 m/sec.

Further, the inventors have experimented a number of numerical analytic tests under various calculated conditions in addition to the above calculated conditions. As a result, when the clearance distance L is in a range of 4.0–10.0 mm, it turns out that the increase percentage of radiating amount and the air flow resistance do not depend on the thickness and the height of the cooling fin, however, nearly have functional relationship with the projection lengths Lc and Lr as shown in FIGS. 4, 5 and 10.

Figure 6:
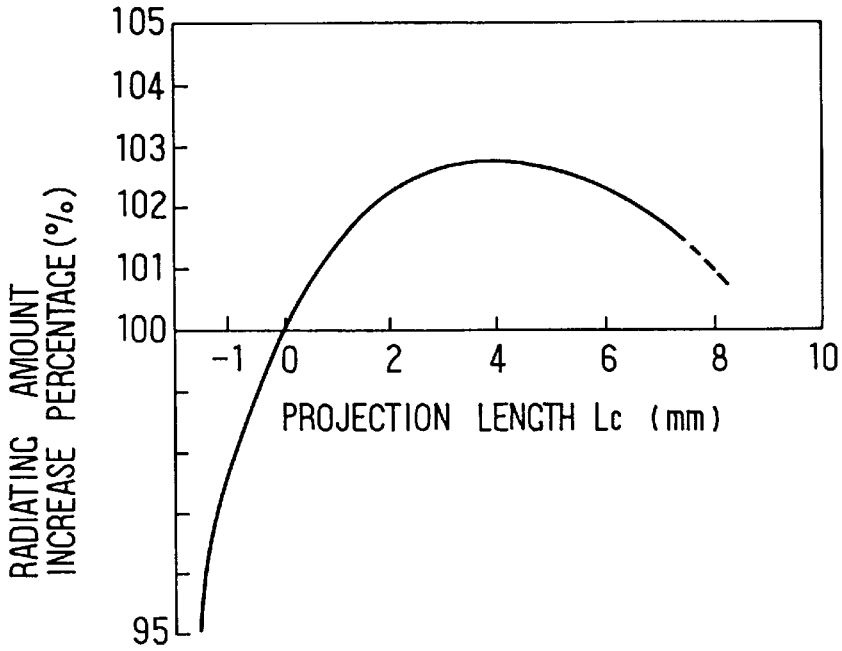
FIG. 6 is a graph showing a relationship between an increase percentage of radiating amount of a cooling fin and a projection length of the cooling fin in case the air flow resistance is considered.
Figure 11:
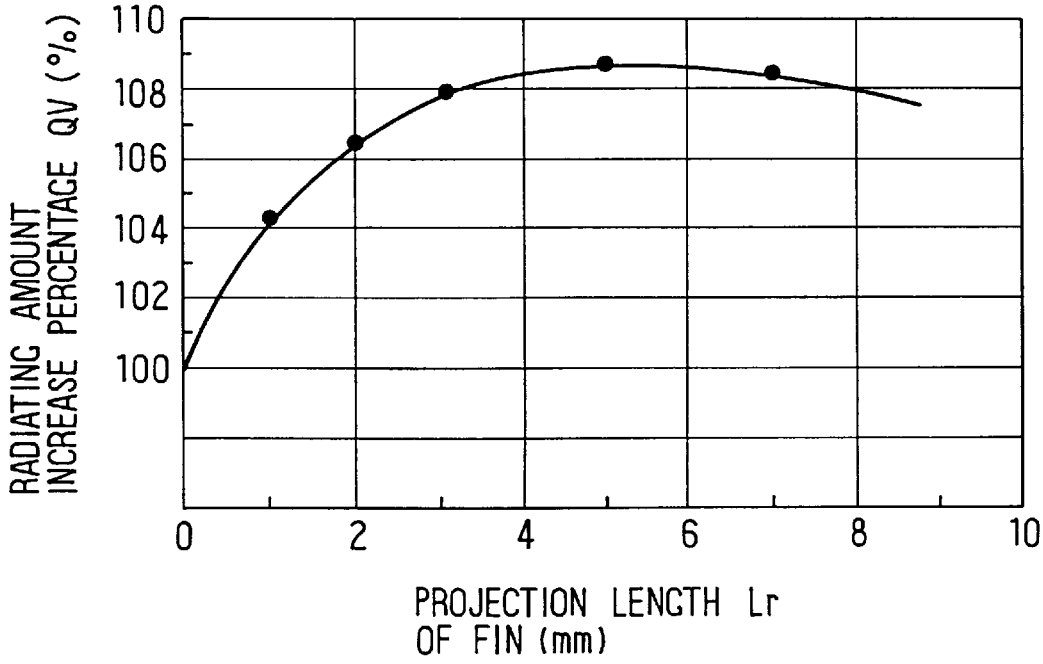
FIG. 11 is a graph showing a relationship between an increased percentage of radiating amount of a cooling fin and a projected size of the cooling fin in case the air flow resistance in the radiator core portion is considered.

When air flow resistance becomes large so that the amount of air passing through the cooling fin is decreased, amounts of heat radiating from the two core portions 2 and 3 per hour are decreased, so that the heat exchange efficiency is decreased. When the relationships between each of the projection lengths Lc and Lr and the increase percentages of radiating amount are calculated while considering the air flow resistance, the calculated results are shown in FIGS. 6 and 11. As shown in FIGS. 6 and 11, the condenser core portion 2 has the maximum increase percentages of radiating amount when the projection length Lc is about 4.0 mm, whereas the radiator core portion 3 has a maximum increase percentages of radiating amount when the projection length Lr is in 5.0–6.0 mm. When the projection lengths Lc and Lr are more than the respective maximum values, both increase percentages of radiating amount are gradually decreased.

Next, the connection ratio E/F of the two cooling fins 22 and 23 will be described.

When the connection ratio E/F becomes larger, the connecting portion 45 of the two cooling fins 22 and 32 becomes larger, and therefore an amount of heat transmitted from radiator core portion 3 to condenser core portion 2 is increased so that the heat exchange efficiency of the condenser core portion 2 is deteriorated.

Figure 9:
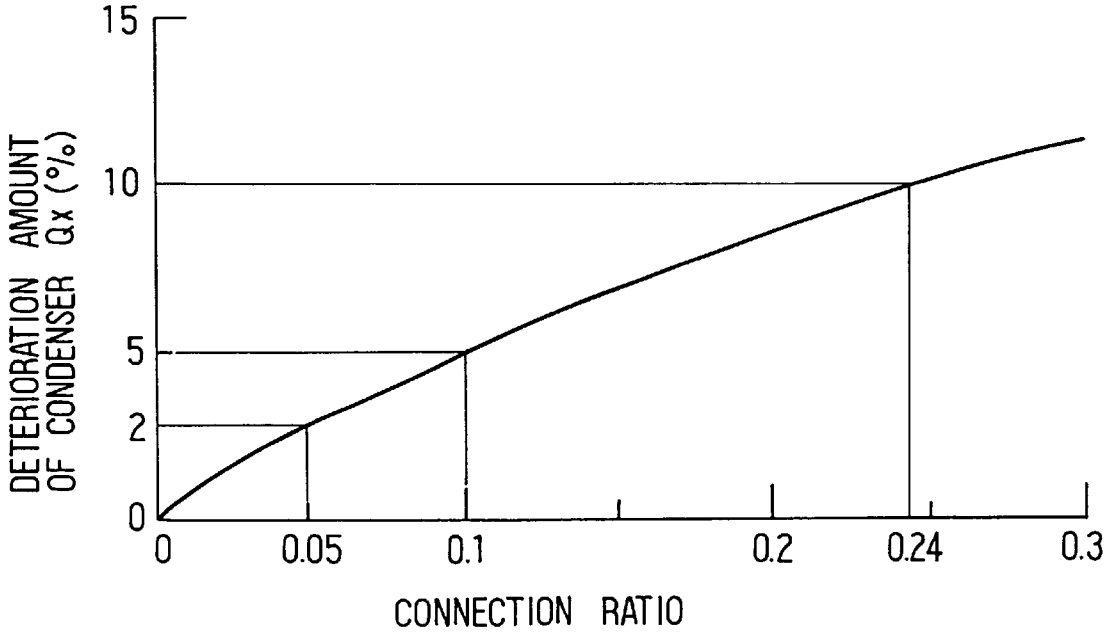
FIG. 9 is a graph showing the relations between a deterioration amount of the condenser and a connection ratio.

The inventors have examined and studied the relationship between the deterioration amount of the heat exchange efficiency of the condenser core portion 2 and the connection ratio E/F quantitatively, and the results are shown in FIG. 9. As shown in FIG. 9, the deterioration amount of the heat exchange efficiency of the condenser core portion 2 is nearly linearly increased when the connection ratio E/F becomes large. It turns out that the deterioration percentages of the heat exchange efficiency of the condenser core portion 2 can be suppressed less than 2% when the connection ratio E/F is equal to 0.05 or less. Further, it also turns out that the deterioration percentages of the heat exchange efficiency of the condenser core portion 2 can be suppressed less than 5% when the connection ratio E/F is equal to 0.1 or less.

The deterioration percentages of the condenser of vertical line in FIG. 9 are calculated by dividing the difference between the heat exchange amounts without having the connecting portion 45 (two core portions 2 and 3 are completely separated) and the heat exchange amounts with having the connecting portion 45 with the heat exchange amounts without having the connecting portion 45.

Next, the characteristics of the first embodiment of the present invention will be described.

Because heat is transmitted from the radiator core portion 3 to the condenser core portion 2 through each the connecting portion 45, the smaller the connection ratio E/F is, the smaller the heat transmitting amount is, as shown in FIG. 9. Further, as shown in FIG. 6, the projection length Lc of the cooling fin 22 of the condenser core portion 2 is made large until a specified size so that the increase percentage of the radiating amount can be improved.

Thus, the projection length Lc of the cooling fin 22 and the connection ratio E/F are suitably selected so that the deterioration amount of the condenser with the connecting portion can be offset by the increase of the radiating amount with projecting the cooling fin 22. Because the cooling fin 22 is projected toward the clearance 46 side between the two core portions 2 and 3, the shape of the heat exchanger 1 can be prevented from being large-sized.

In the first embodiment, the projection length Lc is about 1.7 mm, the connection ratio E/F is about 0.05. That is, because the connection ratio E/F is about 0.05, the deterioration amount is about 2%. However, the projection length Lc is about 1.7 mm, so that the radiating amount of the condenser core portion 2 increases about 2%. Thus, the deterioration amount of the condenser is offset by projecting the cooling fin.

The projection length is suitably selected by the thickness, the shape and material, the louvers 22*b* and 32*b* and the like of the cooling fins 22 and 32. When the connection ratio is equal to 0.05 or less, the projection length is preferably in a range of 1.7–7.0 mm. The length Ls of the clearance 47 between the two cooling fins 22 and 32 may be a length in which the heat transmission is effectively 10=interrupted, more specifically, the length Ls of the clearance 47 is about in a range of 0.5–2.0 mm. In the first embodiment, the length Ls of the clearance between the two cooling fins is about 0.5 mm, the clearance distance L between the two tubes 21 and 31 is about 4.0 mm.

Further, because the cooling fin 32 of the radiator core portion 3 is also projected toward the condenser core portion side 2, the radiating amount is increased in the radiator core portion 3 as shown in FIG. 11. Thus, the shape of the heat exchanger 1 can be prevented from being large-sized, the radiating amount can be increased in the radiator core portion 3. In the first embodiment, the projection length Lr of the cooling fin 32 is about 1.8 mm, the increase percentage of the radiating amount of the cooling fin 32 is about 5%.

Further, the projection lengths Lc and Lr are suitably selected respectively, so that the radiating capacity of the condenser core portion 2 and the radiating capacity of the radiator core portion 3 can be easily controlled. Thus, a desired design can be easily modified without a large design change of the heat exchanger.

Because a plurality of folded portions 22*a* and 32*a* (5–10 folded portions, in the first embodiment) are formed between one of the connected portion 45 and the other connected portion 45 of the plurality of connected portions 45, total cross sectional areas of the plurality of connecting portions 45 which is a cross sectional area of heat transmitting passage of heat transmitted between the two cooling fins 23 and 32 can be made smaller. Thus, the heat transmitting amount between the two cooling fins 22 and 32 can be made smaller, so that the heat transmitting between the two cooling fins 23 and 32 can be effectively interrupted.

Further, in the first embodiment, the cross sectional area of the heat transmitting passage is made smaller so that the heat transmitting between the two cooling fins 22 and 32 is interrupted. As compared with the conventional heat exchanger in which the heat transmitting between the two cooling fins 22 and 32 is interrupted by increasing the heat transmitting passage, the distance between the two cooling fins 22 and 32 can be decreased. Thus, the increase of the size of the heat exchanger 1 is controlled, and the heat transmitting between the two cooling fins 22 and 32 can be effectively interrupted.

Further, because the cooling fins 22 and 32 are integrally formed, the manufacturing cost of the two cooling fins 22 and 32 can be decreased, and as a result, the manufacturing cost of the heat exchanger 1 can be decreased.

A second embodiment of the present invention will be described.

In the second embodiment, the heat exchange efficiency of an automotive heat exchanger is improved in view of a vehicle design concept in recent years, in which a space of a passenger compartment is expanded by downsizing an engine compartment.

Figure 12:
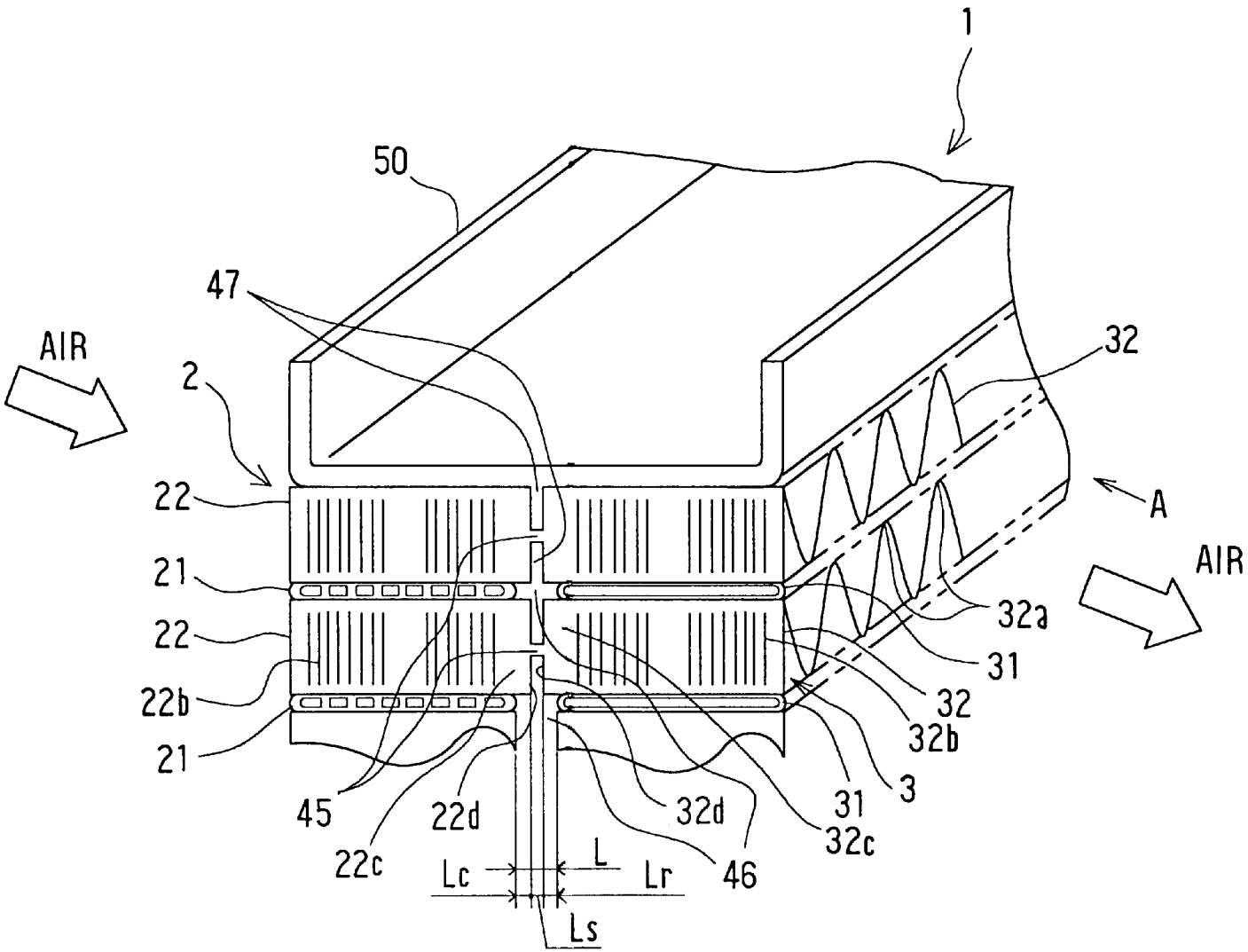
FIG. 12 is a perspective view showing a core portion of a heat exchanger (which corresponds to a cross-section taken along line B—B of FIG. 2) according to a second embodiment of the present invention.

Specifically, as shown in FIG. 12, the side plates 23 and 33 in FIG. 1 are integrated (hereinafter, the integrated side plate is simply referred to as side plate (partition member) 50.) and the clearance 46 between the two core portions 2 and 3 is closed so that an amount of air passing through the condenser core portion 2 is increased.

Next, the reason why the amount of air passing through the condenser core portion 2 is increased when the clearance 46 is closed by the side plate will be described.

In recent years, as described above, to downsize the engine compartment, the equipment in the engine compartment are closely disposed to the extent that the equipment can be fixed or maintained by a serviceman, similarly, the radiator core portion 3 is disposed closely to the other equipment.

However, when the radiator core portion 3 is simply close to the equipment, air flow in the engine compartment is deteriorated (stayed), and therefore an amount of air passing through the radiator core portion is decreased so that the radiating capacity of the radiator core portion 3 is decreased.

Figure 13:
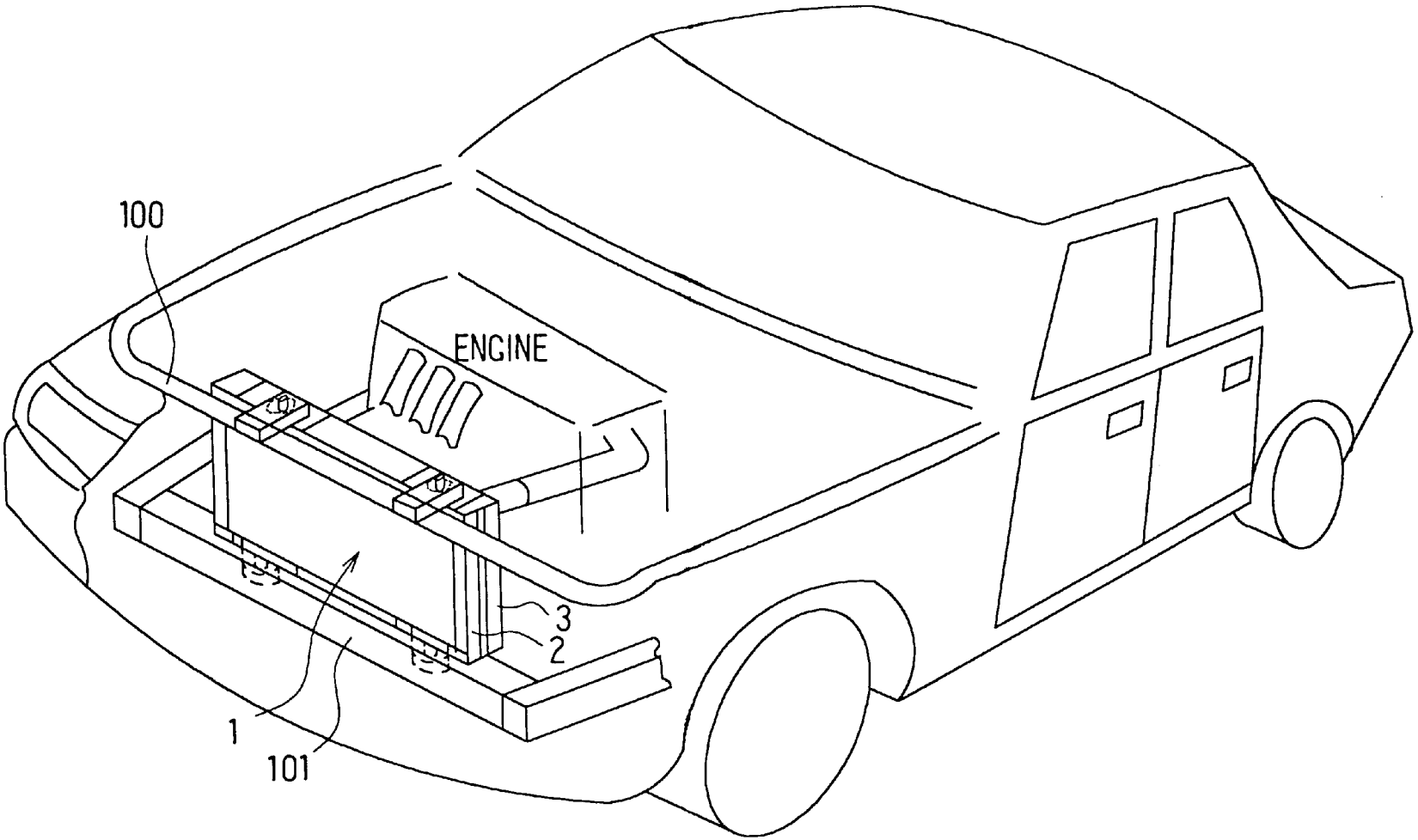
FIG. 13 is a perspective view showing a state in which an automotive heat exchanger of the present invention is mounted on a vehicle.
Figure 14:
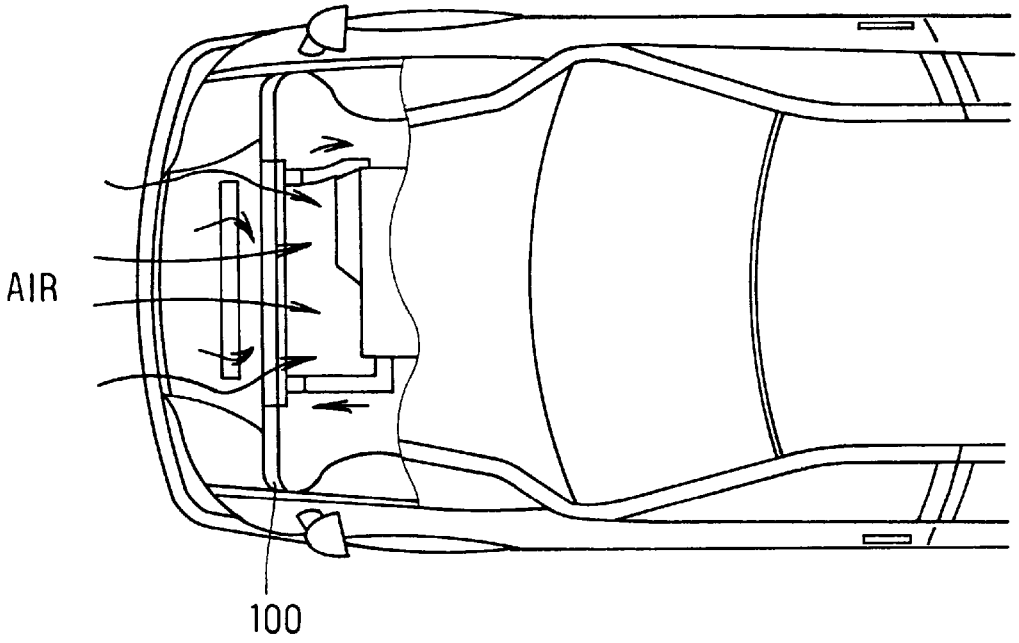
FIG. 14 is a top view showing a state in which an automotive heat exchanger of the present invention is mounted on a vehicle.

Generally, to secure a certain amount of air into the radiator core portion 3, the radiator core portion 3 is installed at the front side of the vehicle (the engine compartment) as shown in FIGS. 13 and 14. Further, it is not limited to the second embodiment, the radiator core portion 3 is usually so disposed that air flowing from front side of a vehicle toward the engine compartment effectively join together into the radiator core portion 3.

Specifically, clearances (distance) between the radiator core portion 3 and the other equipment which are closely disposed to the radiator core portion 3 and clearances between the radiator core portion 3 and reinforcing members of the vehicle such as upper reinforcing member (upper cross member) 100 and lower reinforcing member (lower cross member) 101 are made smaller, so that it has a construction (layout) in which air flowing from the front side of vehicle into the engine compartment does not directly flow toward the downstream side by bypassing the radiator core portion 3.

Figure 15:
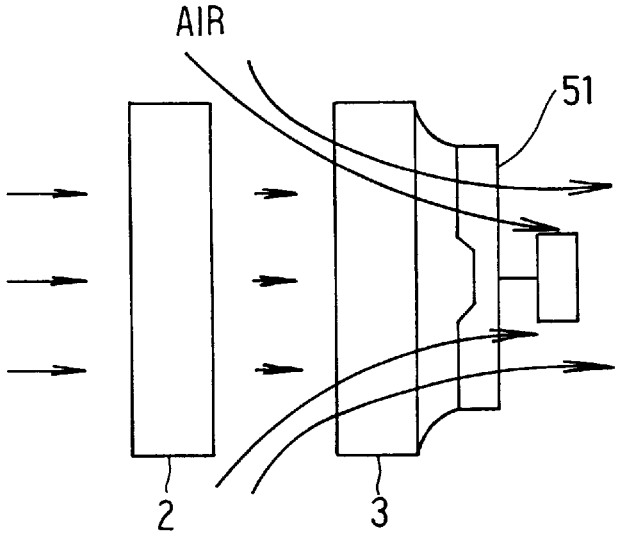
FIG. 15 is a diagrammatic view showing an air flow when the automotive heat exchanger is mounted on the vehicle.

Thus, as shown in FIG. 15, air flowing from the front side of a vehicle toward the engine compartment flows so as to join together into the radiator core portion 3 as approaching the radiator core portion 3. Therefore, when the condenser core portion 2 is located at an upstream air side of the radiator core portion 3, air flowing from the front side of a vehicle toward the engine compartment is divided into two air flows including one air flow bypassing the condenser core portions 2 and passing through the radiator core portion 3 from the clearance 46 between the condenser core portion 2 and radiator core portion 3, and the other air flow straightly passing through the two core portions 2 and 3.

When the clearance 46 is closed at the end portions of the two core portions 2 and 3, air bypassing the condenser core portion 2 and flowing into the clearance 46 is interrupted, and therefore the air bypassing the condenser core portion 2 does not flow through the clearance 46 so that air only flows through the condenser core portion 2.

Thus, when the clearance 46 is closed at the end portions of the two core portions 2 and 3, as compared with the case without closing the clearance 46, the amount of air passing through the condenser core portion 2 located at an upstream air side of the radiator core portion 3 is increased by the amount of air bypassing the condenser core portion 2 (hereinafter, this phenomenon (effect) referred to as duct effect).

To quantitatively examine the above described duct effect, the inventors have experimented the relationship between the distance L of the two tubes 21 and 31 and the increase percentage of an amount of air passing through the condenser core portion 2 when both projection lengths Lc and Lr of the two cooling fins 22 and 32 are 0 mm and the two core portions 2 and 3 are independently separated (the connection ratio E/F=0) in an automotive heat exchanger.

Figure 16:
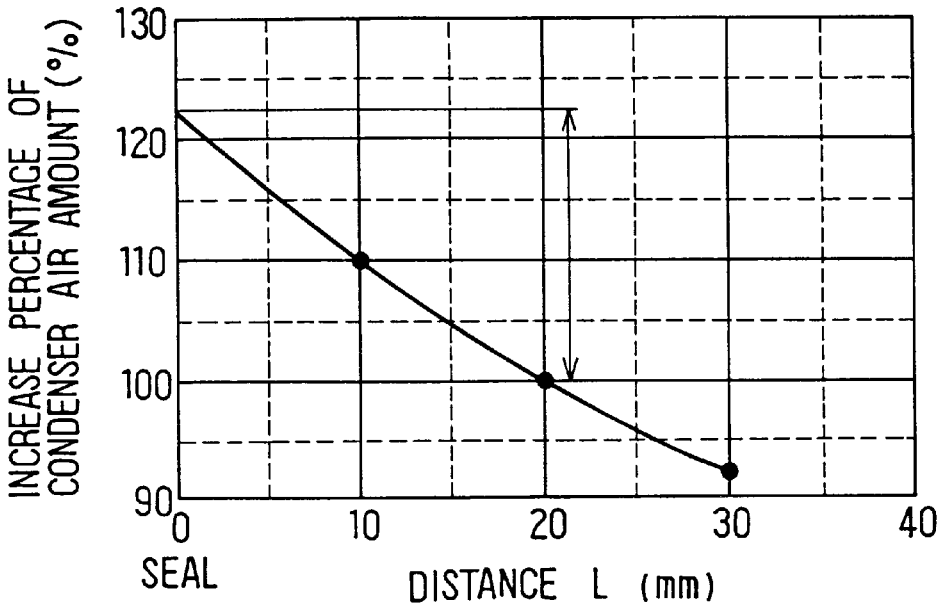
FIG. 16 is a graph showing a relationship of a distance L between two tubes and an increase percentage of air passing through the condenser core portion.

FIG. 16 is a graph showing the experimented results. The increase percentages are shown by percentages based on a standard distance in which an average distance between the two tubes 21 and 31 is 20 mm.

In the above described experiment, supposing an actual state where the automotive heat exchanger of the second embodiment is mounted on a vehicle, the radiator core portion 3 is located at a downstream air side of the condenser core portion 2, and a cooling fan 51 is located at downstream air side of the radiator core portion 3.

In FIG. 16, a state of the distance L=0 is studied, the following results can be obtained. That is, when the distance L=zero, the two core portions 2 and 3 are contacted with each other, and therefore the air flow bypassing the condenser core portion 2 is not generated. That is, as viewed from a direction of air flow in the above described experiment, the state in which the distance L=zero is similar to the state in which the clearance 46 between the two core portions 2 and 3 is closed.

Thus, as shown in FIG. 16, the smaller the distance L is, that is, the closer the distance L approaches zero, the larger the amount of air passing through the condenser core portion 2 becomes. Thus, the clearance 46 is closed so that the duct effect can be obtained.

Further, in the automotive heat exchanger in which the clearance 46 between the two core portions 2 and 3 are closed, a pressure loss when the air passes through the clearance between the two core portions 2 and 3 is sufficiently small as compared with a pressure loss when the air passes through the two core portions 2 and 3, and therefore the pressure loss when the air passes through the clearance 46 can be omitted. That is, the above described experimented state in which the distance L=zero is quantitatively similar to the state in which the clearance 46 between the two core portions 2 and 3 is closed.

Thus, in the automotive heat exchanger in which both projection lengths Lc and Lr of the two cooling fins 22 and 32 are 0 mm and the two core portions 2 and 3 are independently separated, when the distance L is 2.0 mm, for example, the increase percentage of air amount with the duct effect is a difference between the increase percentage of air volume of the distance L=0 and the increase percentage of air volume of the distance L=20.0 mm, that is, the difference is 20%.

Figure 17:
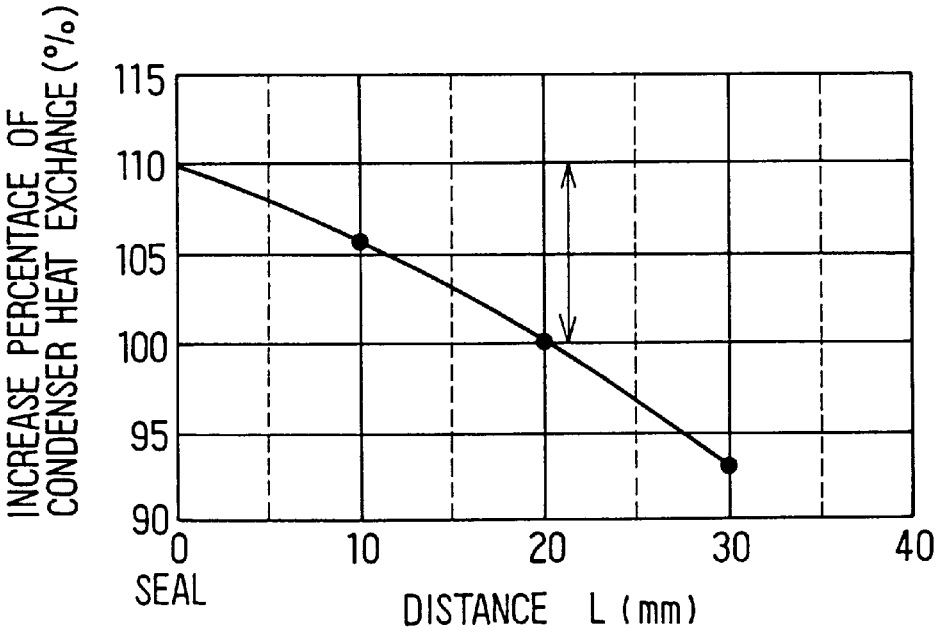
FIG. 17 is a graph showing the relationship of the distance L between two tubes and an increased percentage of the heat exchange of the condenser core portion.

Further, in the above described experiment, FIG. 17 shows the relationship between the distance L and the increase percentage of the heat exchange of the condenser core portion 2. Similarly to FIG. 16, in FIG. 17, the state in which the distance L=zero is similar to the state in which the clearance 46 is closed. Thus, the smaller the distance L is, that is, the closer the distance L approaches zero, the higher the heat exchange percentage of the condenser core portion 2 becomes.

It can be considered that heat is transmitted from the radiator core portion 3 side toward the condenser core portion 2 side through the integrated side plate 50 so that the heat exchange efficiency of the condenser core portion 2 is decreased. However, in the side plate 50, an effective cross sectional area contributing to the heat exchange is a slight portion close to the two header tanks 34 and 36 of the radiator core portion 3, and further, the effective cross sectional area is very small as compared with the core area of the condenser core portion 2. Therefore, the decrease of the heat exchange due to the heat transmission can be nearly omitted.

As described above, because the two cooling fins 22 and 32 are integrally formed with the louvers 22*b* and 32*b* by a roller forming method or the like, it is difficult to form the connecting portion 45 when the connection ratio E/F is made small, so that the manufacturing cost of the cooling fin is lot, increased. Thus, it is preferable that the connection ratio E/F is made as large as possible in view of manufacture for the cooling fin.

On the other hand, when the connection ratio E/F is made large, the heat exchange of the condenser core portion 2 is decreased as described above, so that it is not preferable that the connection ratio E/F is excessively made large.

For example, in the automotive heat exchanger in which the distance L=20.0 mm, the heat exchange of the condenser core portion 2 can be increased to 10% by only the duct effect, and therefore the connection ratio E/F can be increased to the value (the connection ratio E/F=0.24) corresponding to 10% deterioration of the condenser (refer to FIG. 17).

Further, when the connection ratio E/F is equal to 0.1 or less, the deterioration percentage of the condenser is 5% (refer to FIG. 9). Therefore, when the increase percentage of the heat exchange will be increased to 10% by the duct effect, even if the projection length (deviated amount) Lc is −1.5 mm (when the projection length Lc is −1.5 mm, the radiating amount of the condenser core portion 2 is deteriorated by about 5%, refer to FIG. 6), the deterioration percentages of the radiating amount of the condenser core portion 2 can be offset.

The projection length (deviated amount) Lc is a position of an end of the cooling fin 22 of the condenser core portion 2 placed at the radiator core portion 3 side when the end of the condenser tube 21 placed at the radiator tube 31 side is as a standard position (0) and the direction from the condenser tube 21 to the radiator tube 31 side is a right direction. That is, the projection length (deviated amount) Lc=−1.5 mm shows a state in which the end portion of the cooling fin 22 is placed in more upstream than the end portion of the condenser tube 21.

The inventors have compared and studied the manufacturing costs of the cooling fins and the heat exchange effects of the condenser core portion 2 in automotive heat exchangers having various specifications. As a result, it comes to a conclusion that the connection ratio E/F is appropriately equal to 0.1 or less. Further, if the increase of the increase percentage of the heat exchange with the duct effect is considered as described above, the projection length (deviated amount) Lc may be in a range of 5.0–7.0 mm.

Because the clearances between the two header tanks 24 and 25 of the condenser core portion 2 and the two header tanks 34 and 36 of the radiator core portion 3 are sufficiently small, air hardly flows into the clearance 46 between the two core portions 2 and 3 through the clearances between the header tanks. Therefore, in the second embodiment, a special work for closing the clearance 46 is not needed.

However, when the distance L is sufficiently large and the clearances between the two header tanks 24 and 25 of the condenser core portion 2 and the header tanks 34 and 36 of the radiator core portion 3 become large, it is preferable that the clearance 46 between the two core portions 2 and 3 is closed by a partition plate or the like described later.

A third embodiment of the present invention will be described.

In the third embodiment, the length Ls of the clearance 46 between the two cooling fins 22 and 32 is made small to a proper value so that the duct effect can be obtained without closing the clearance 46 by the side plate 50 or the partition plate described later. Hereinafter, the length Ls of the clearance 46 between the two cooling fins 22 and 32 will be described.

That is, the smaller the length Ls of the clearance 47 is, the larger the resistance of air flowing into the clearance 46 between the two core portions 2 and 3 is. Therefore, it is supposed that, the smaller the length Ls is, the closer the state in which the clearance 46 is more closed becomes.

The inventors have experimented on the comparison between the amount of air passing through the condenser core portion 2 of the automotive heat exchanger in which the length Ls of the clearance 47 between the two cooling fins 22 and 32 is zero and the amount of air passing through the condenser core portion 2 of the automotive heat exchanger in which the clearance 46 between the two core portions 2 and 3 is closed. As a result, the inventors have confirmed that the two air amounts are nearly equal. Thus, by making the length Ls of the clearance 47 between the two cooling fins 22 and 32 smaller, the duct effect can be obtained.

As can be apparent from the above described comparison experiment, the amount of air passing through the condenser core portion 2 with the duct effect is not influenced by the distance L between the two tubes 21 and 31, however, is influenced by the length Ls of the clearance 47 between the two cooling fins 22 and 32. Thus, the experimental results shown in FIGS. 16 and 17 may be considered as that the graphs respectively show the relationships between the length Ls of the clearance 47 and the increase percentage of the amount of air passing through the condenser core portion 2 and the relationship between the length Ls of the clearance 47 and the increase percentage of the heat exchange of the condenser core portion 2.

The inventors have compared the merit of the duct effect by decreasing the length Ls of the clearance 47 with the demerit by increasing the air flow resistance. As a result, it is preferable that the length Ls of the clearance 47 is equal to 5.0 mm or less ($0<Ls\leqq 5$). Further, when the improvement of the increase percentage of the heat exchange with the duct effect is considered, the projection length (deviated amount) Lc may be in a range of −1.0–7.0 mm.

However, as shown in FIG. 11, because the increase percentage of the radiating amount becomes the maximum when the projection length Lr is in a range of 5.0–6.0 mm, and the graph of the radiating capacity of the radiator core portion 3 draws a mountain shape, the radiating capacities are nearly equal when the projection length Lr is 8.0 mm and the projection length Lr is 3.0 mm. Thus, even if the projection length Lr is equal to 8.0 mm or less, the present invention can be embodied.

Figure 18:
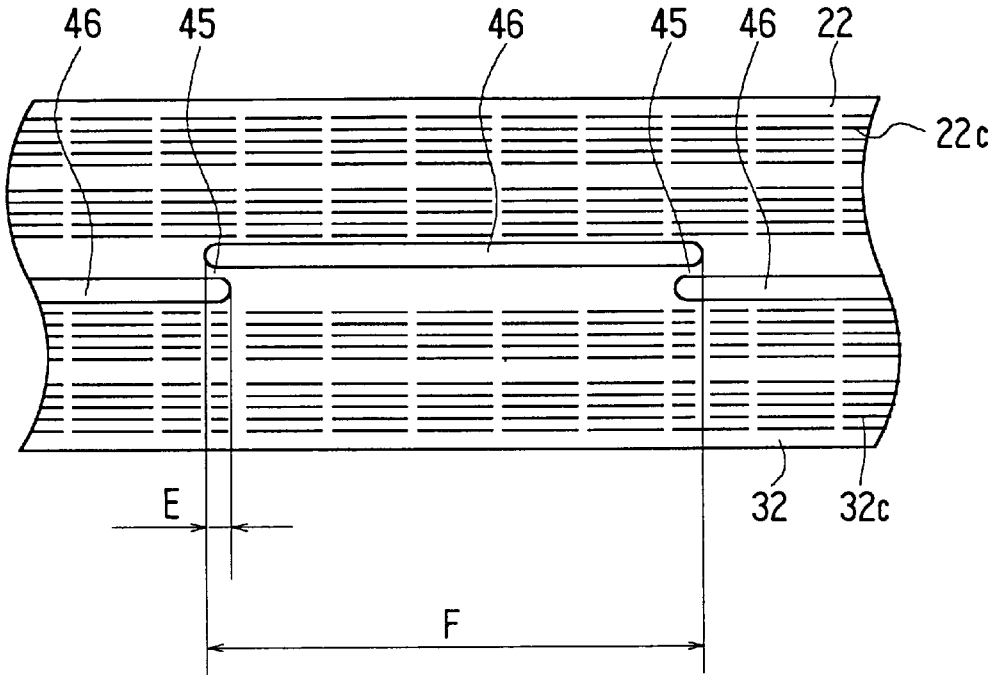
FIG. 18 is a plan view showing a cooling fin according to a modification of the present invention.
Figure 19:
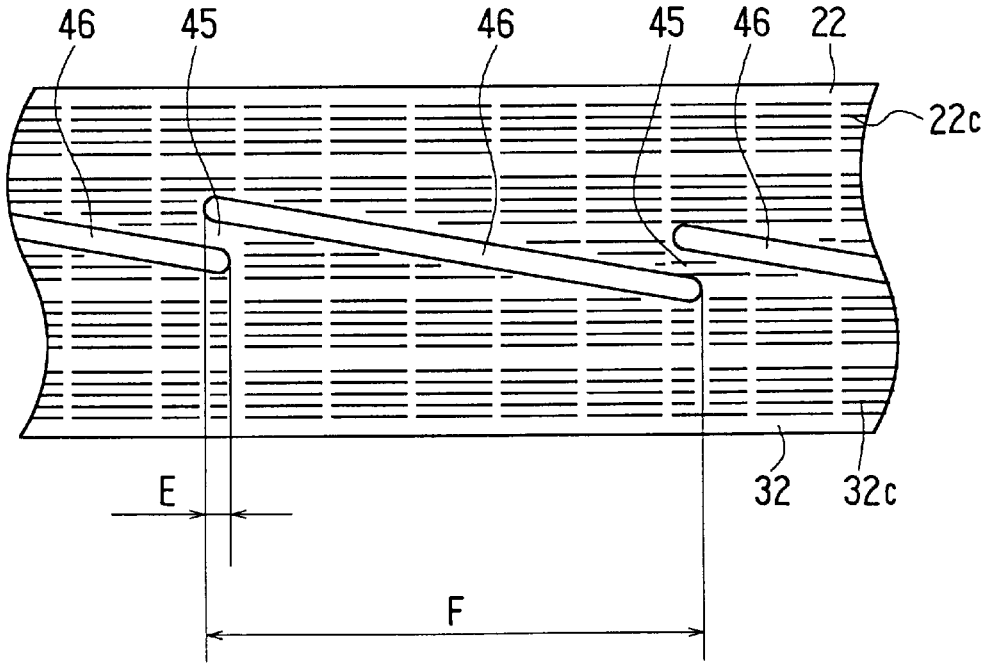
FIG. 19 is a plan view showing a cooling fin according to another modification of the present invention.

Further, as shown in FIG. 18, the clearances 47 may be formed in the width direction alternately so as to overlap with each other. Further, the clearance 47 may be slantingly formed so that the longitudinal direction of the clearance 47 has a predetermined angle with reference to the longitudinal direction of the cooling fin.

A fourth embodiment of the present invention will be described.

Figure 20A:
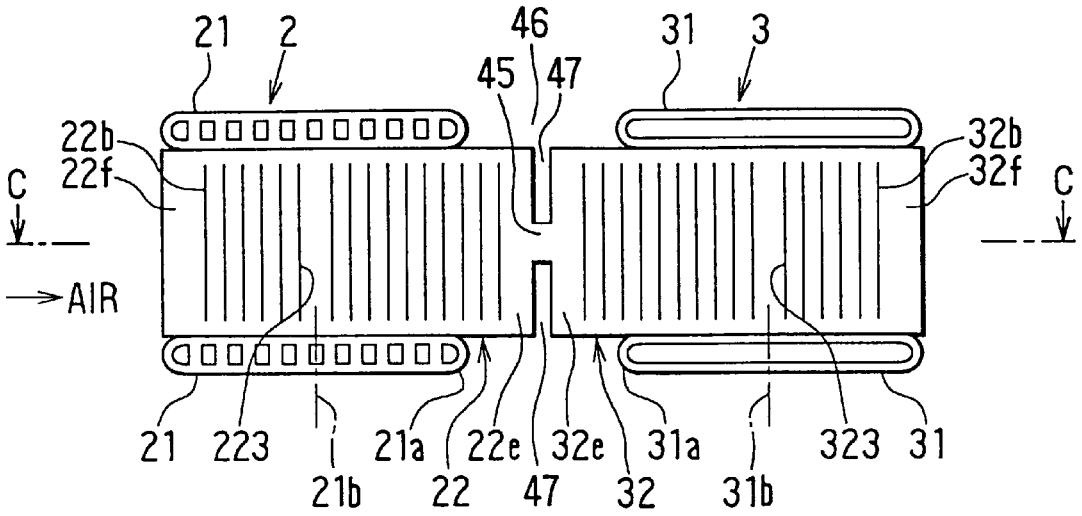
FIG. 20A is a plan view showing tubes and cooling fins according to the fourth embodiment.
Figure 20B:
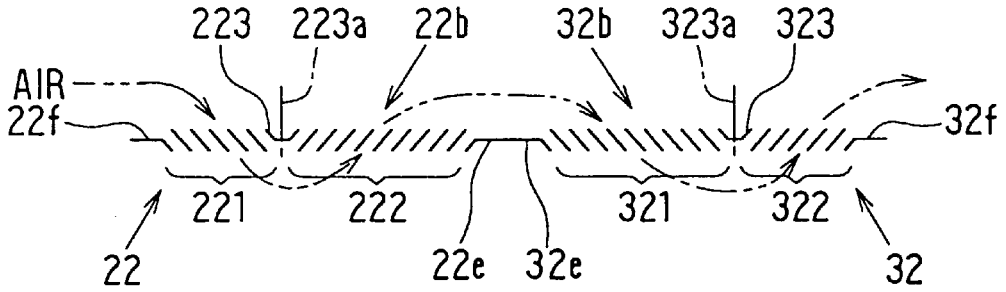
FIG. 20B is a cross sectional view taken along line C—C in FIG. 20A.

As shown in FIG. 20A, the corrugated cooling fin 22 of the condenser core portion 2 has a projection portion 22*e* which protrudes from the air downstream side top end 21*a* toward the clearance 46 side. In a similar way, the corrugated cooling fin 32 of the radiator core portion 3 has a projection portion 32*e* which protrudes toward the clearance side 46. In this fourth embodiment, the louvers 22*b* and 32*b* are formed also these projection portions 22*e* and 32*e*.

As show in FIG. 20A, at the most air upstream side of the cooling fin 22, a stripper portion 22*f* like a plane portion is formed. At the most air downstream side of the cooling fin 32, a stripper portion 32*f* is formed. These stripper portions 22*f* and 32*f* are necessary to remove the cooling fins 22 and 32 from a forming roller after they are formed. Thus, the louvers 22*b* and 32*b* can not be provided at the stripper portions 22*f* and 32*f*. The louvers 22*b* and 32*b* can not be provided at the top portion of the projection portion 22*e* and 32*e* because of the same reason.

The louver 22*b* of the condenser cooling fin 22 consists of first louver group 221, second louver group 222, and a turning louver 223. The turning louver 223 is arranged between the first louver group 221 and the second louver group 222. The first louver group 221 and the second louver group 222 tilt in the opposite direction with each other. The central axis 223*a* of the turning louver 223 corresponds to the central axis 21*b* of the condenser tube 21 in its cross-sectional longitudinal direction. The first louver group 221 is disposed between the stripper portion 22*f* and the turning louver 223. The second louver group 222 is disposed from the turning louver 223 (the center of the condenser tube in its cross-sectional longitudinal direction) to the projection portion 22*e* continuously.

In this embodiment, as shown in FIG. 20A, five louvers are formed in the first louver group 221 and nine louvers are formed in the second louver group 222.

In the radiator cooling fin 32, louvers are formed in the same way as the condenser cooling fin 22. Here, nine louvers are formed in a first louver group 321 disposed at the air upstream side, and five louvers are formed in a second louver group 322 disposed at the air downstream side.

As described above, in both corrugated fins 22 and 32, the number of the louver in the first louver group and the second louver group are not the same. That is, these louvers are arranged unsymmetrically.

Next, an operation of the above-described structure will be explained.

When a cooling fan (not illustrated) which is disposed at the air downstream side of the radiator core portion 3 operates, the cooling air passes through the condenser core portion 2 and the radiator core portion 3. At the same time, a gas phase refrigerant flowing out of a compressor flows into the first header tank 24 through the refrigerant inlet 26. The gas phase refrigerant flows in the condenser tube 21 while being heat exchanged with the cooling air to be condensed. The condensed liquid phase refrigerant is collected in the second header tank 25 and flows out of the condenser core portion 2 through the refrigerant outlet 27.

A hot engine coolant flows from an engine into the first header tank 34 through the engine coolant inlet 35. The engine coolant flows in the radiator tube 31 while being heat exchanged with the cooling air to be cooled. The cooled engine coolant is collected in the second header tank 36 and flows out of the radiator core portion 3 through the engine coolant outlet 37.

Here, heat exchanging efficiencies in the condenser core portion 2 and the radiator core portion 3 depend on heat transmitting abilities of the cooling fins 22 and 32. In the present invention, the second louver group 222 is formed from the turning louver 223 to the projection portion 22*e* of the condenser cooling fin 22 continuously, and the first louver group 321 is formed from the turning louver 323 to the projection portion 32*e* of the radiator cooling fin 32 continuously. That is, the louvers are formed around the top end portions 21*a* and 31*a* of the condenser tube 21 and the radiator tube 31 which face each other. Thus, the number of the louvers in these louver groups 222 and 321 can be increased, and their heat transmitting abilities are improved. Accordingly, amount of heat emitted from the refrigerant flowing in the condenser tube 21 through the cooling fin 22 and the engine coolant flowing in the radiator tube 31 through the cooling fin 32 to the air is increased effectively.

A fifth embodiment of the present invention will be described.

Figure 21A:
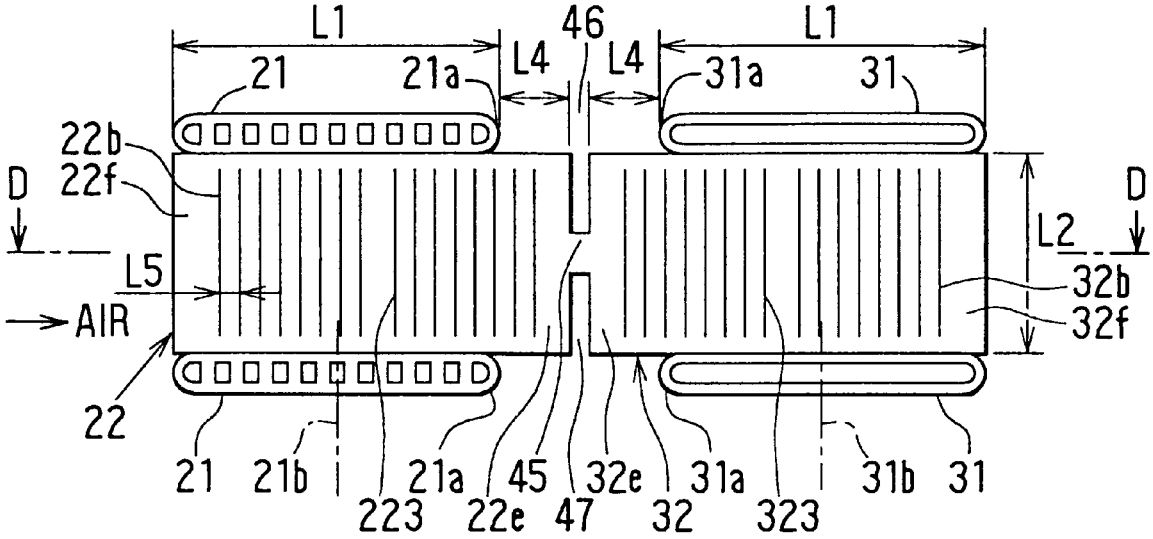
FIG. 21A is a plan view showing tubes and cooling fins according to the fifth embodiment.
Figure 21B:
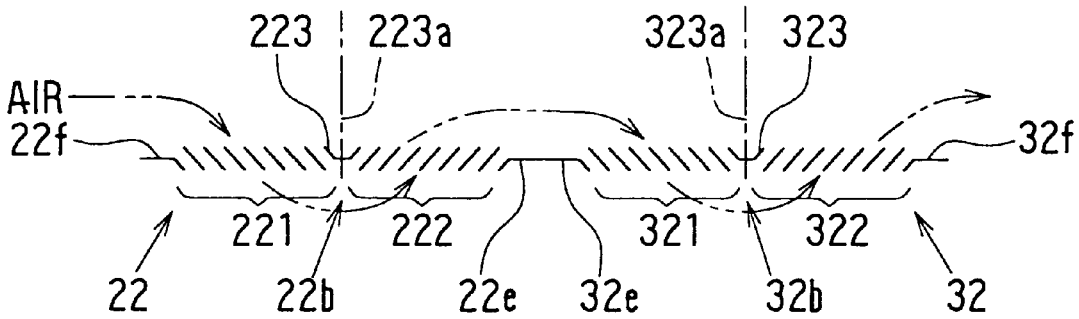
FIG. 21B is a cross sectional view taken along line D—D in FIG. 21B.

According to the fifth embodiment, as shown in FIGS. 21A and 21B, seven louvers are formed in each first louver group 221 and second louver group 222 of the condenser cooling fin 22. That is, the numbers of the louvers in the first louver group 221 and the second louver group 222 are the same, and these louver groups 221 and 222 are symmetrical relative to the central axis 223*a* of the turning louver 223. In a similar way, seven louvers are formed in each first louver group 321 and second louver group 322 of the radiator cooling fin 32. That is, the numbers of the louvers in the first louver group 321 and the second louver group 322 are the same, and these louver groups 321 and 322 are symmetrical relative to the central axis 323*a* of the turning louver 323. The central axis 223*a* of the turning louver 223 is off set relative to the central axis 21*b* of the condenser tube 21 in the cross sectional longitudinal direction. The central axis 323*a* of the turning louver 323 is off set relative to the central axis 31*b* of the radiator tube 31 in the cross sectional longitudinal direction.

Figure 22A:
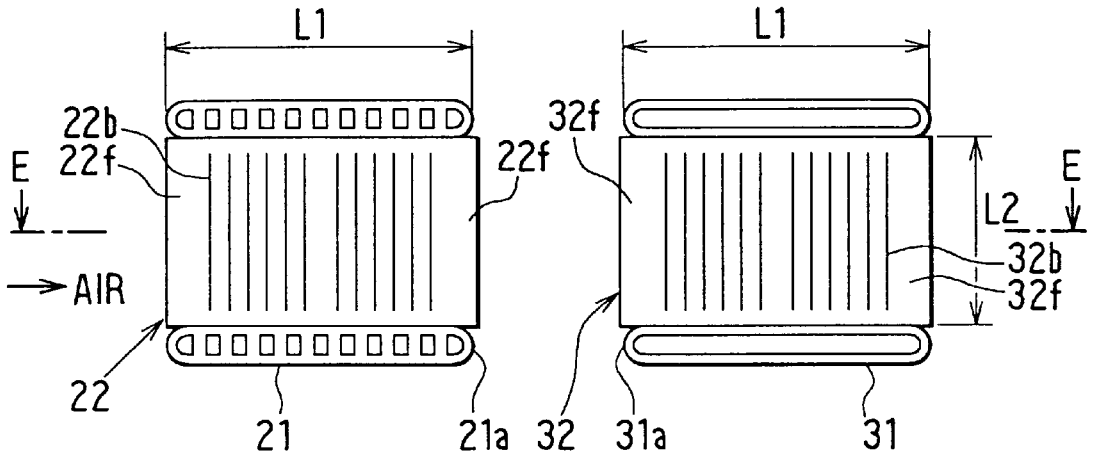
FIG. 22A is a plan view showing tubes and cooling fins according to the comparative example.
Figure 22B:
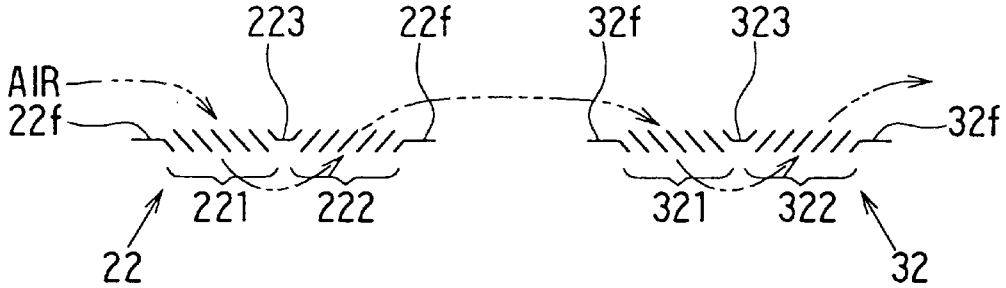
FIG. 22B is a cross sectional view taken along line E—E in FIG. 22A.

FIGS. 22A and 22B show a comparative example. In this comparative example, the projection portions 22*e* and 32*e* are not provided in both condenser cooling fin 22 and radiator cooling fin 32. The stripper portions 22*f* and 32*f* are formed in both air upstream and air downstream side top ends of the condenser cooling fin 22 and the radiator cooling fin 32 respectively.

The following describes an experimental result of the comparison between the comparative example and the present fifth embodiment. Here, as an experimental condition, width length Li of the tubes 21 and 31 in their cross sectional longitudinal direction is 16 mm, gap 46 between the tubes 21 and 31 is 10 mm, height L2 of the cooling fins 22 and 32 is 8.0 mm, fin pitch L3 (see FIG. 7) is 3 mm, projection length L4 of the projection portions 22*e* and 32*e* is 2 mm. Louver pitch L5 is 1.0 mm, and louver tilt angle 23°.

As is understood from the experimental result, the number of the louvers relative to the width length Li of the tube 21 and 31 is increased by two pieces more than that in the comparative example. Thus, the heat transmitting ratio is increased by 10% more than that in the comparative example, and the amount of emitted heat is increased by 3% more than that in the comparative example.

A sixth embodiment of the present invention will be described.

Figure 23A:
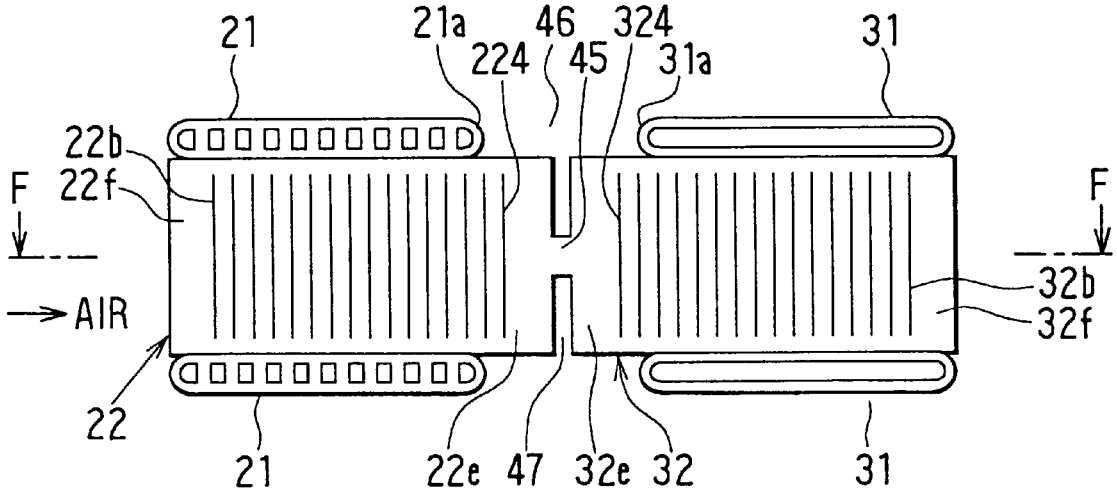
FIG. 23A is a plan view showing tubes and cooling fins according to the sixth embodiment.
Figure 23B:
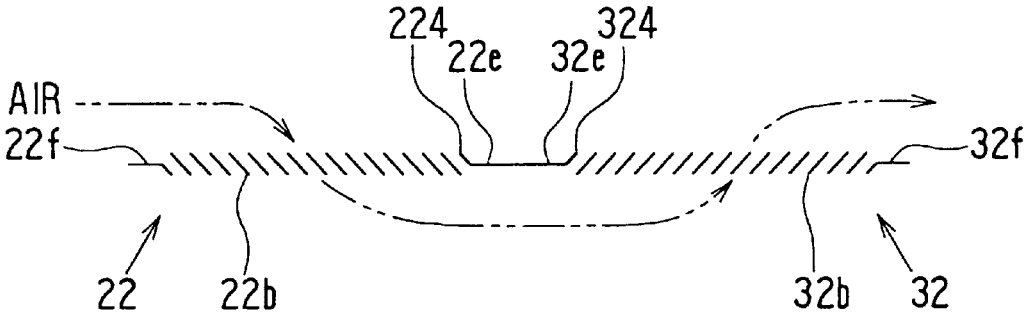
FIG. 23B is a cross sectional view taken along line F—F in FIG. 23B.

According to the sixth embodiment, as shown in FIG. 23A, the louver 22*b* in the condenser cooling fin 22 consists of a single louver group in which all the louvers 22*b* tilt in the same direction by the same angle. That is, the turning louver 223 is not provided. In a similar way, the louver 22*b* in the radiator cooling fin 32 consists of a single louver group in which all the louvers 32*b* tile in a opposite direction to the louvers 22*b* by the same angle, and the turning louver 323 is not provided. These louvers 22*b* and 32*b* are formed also in the projection portions 22*e* and 32*e*. Turning louvers 224 and 324 are formed to be adjacent to end louvers 22*b* and 32*b* disposed at the gap 46 side end of each louver groups respectively.

In the present sixth embodiment also, the number of the louvers relative to the width length of the tubes 21 and 31 can be increased like the fourth and fifth embodiments.

In the above fourth through sixth embodiments, the condenser cooling fin 22 and the radiator cooling fin 32 are connected through the connecting portion 45. However, the present invention can be applied to a heat exchanger in which the condenser cooling fin 22 and the radiator cooling fin 32 are formed independently by removing the connecting portion 45.

In the above described embodiments, the cooling fins 22 and 32 are projected toward only the clearance 46 side. However, the cooling fins can be projected to a side of opposing the clearance 46.

Further, in the second embodiment, the clearance 46 is closed by the side plate 50. However, a partition plate for closing the clearance 46 may be assembled into the two side plates 23 and 33 without integrating the two side plates 23 and 33. In this case, preferably, the partition plate is formed by a member having a small heat exchange efficiency such as resin.

Further, in the side plate 50, the wall thickness corresponding to the portion of the clearance 46 may be made thinner than the other portion.

Further, in the above described embodiments, the present invention is applied to the heat exchanger in which the condenser core portion 2 and the radiator core portion 3 are integrated. However, it is to be noted that the present invention can be applied to various heat exchangers in which two heat exchanging core portions, to carry out a heat exchange between two kinds of fluid with each other, are integrated.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger comprising:

a plurality of first tubes in which a first refrigerant flows;

a corrugated first cooling fin in which a plurality of folded portions is formed continuously, said corrugated first cooling fin being disposed between adjacent first tubes;

a plurality of second tubes in which a second refrigerant flows, said second tubes being disposed in parallel with said first tubes;

a corrugated second cooling fin in which a plurality of folded portions is formed continuously, said corrugated second cooling fin being disposed between adjacent second tubes;

a plurality of connecting portions for connecting a side end portion facing the adjacent second cooling fin of said first cooling fin and a side end portion facing the adjacent first cooling fin of said second cooling fin;

a plurality of clearances disposed between said corrugated first cooling fin and said corrugated second cooling fin, said plurality of clearances being formed by said plurality of connecting portions;

wherein at least two of said folded portions of said first and second cooling fins are formed between adjacent connecting portions.

2. A heat exchanger according to claim 1, wherein each of said first and second cooling fins includes a flat portion formed between adjacent folded portions, and said connecting portions are formed between each pair of said flat portion of said first cooling fin and said flat portion of said second cooling fin.

3. A heat exchanger according to claim 1, wherein said connecting portion has a portion in parallel with a longitudinal direction of said first and second cooling fins, a length of said portion being less than 5% of a length between adjacent connecting portions when said first and second cooling fins are unfolded.

4. A heat exchanger according to claim 3, wherein said first cooling fin is projected from said first tubes toward said second tubes with a projection length being in a range of 1.7 to 7.0 mm.

5. A heat exchanger according to claim 3, wherein said second cooling fin is projected from said second tubes toward said first tubes with a projection length being equal to 5.0 mm or less.

6. A heat exchanger according to claim 1, wherein said connecting portion has a portion in parallel with a longitudinal direction of said first and second cooling fins, a length of said portion being less than 10% of a length between adjacent connecting portions when said first and second cooling fins are unfolded.

7. A heat exchanger according to claim 1, wherein, said first tubes are used for condenser tubes of a condenser core portion for condensing a refrigerant of a condenser for forming a refrigeration cycle, said second tubes are used for radiator tubes of a radiator core portion of a radiator for cooling an automotive engine, and wherein said condenser core portion is disposed at an upstream air side of said radiator core portion.

8. A heat exchanger according to claim 1, wherein said corrugated first cooling fin includes a first projection portion projected from said first tubes toward said second tubes, said corrugated second cooling fin includes a second projection portion projected from said second tubes toward said first tubes, a first plurality of louvers are formed on said corrugated first cooling fin in a range from said adjacent first tubes to said first projection portion continuously, and a second plurality of louvers are formed on said corrugated second cooling fin in a range from said adjacent second tubes to said second projection portion continuously.

9. A heat exchanger according to claim 8, wherein a turning louver is provided among one of said first and second plurality of louvers for turning a fluid flowing outside of said tubes, and a number of said louvers is different between both sides of said turning louver.

10. A heat exchanger according to claim 9, wherein a central axis of said turning louver is off set to a central axis of a respective one of said adjacent first and second tubes in its cross sectional longitudinal direction.

11. A heat exchanger according to claim 8, wherein a turning louver is provided in said projection portion for turning a fluid flowing outside of said tubes.

12. A heat exchanger according to claim 1, wherein said plurality of connecting portions have a slit for reducing an amount of heat transfer between said corrugated first cooling fin and said corrugated second cooling fin.

13. A heat exchanger comprising:

a plurality of first tubes in which a first refrigerant flows;

a plurality of second tubes in which a second refrigerant flows, said second tubes being disposed in parallel with said first tubes; and a cooling fin in which a plurality of folded portions is formed continuously in a corrugated shape, said cooling fin being disposed between adjacent first tubes and adjacent second tubes, wherein said cooling fin includes a plurality of slit-shaped recess portions formed between said first tubes and said second tubes, a longitudinal direction of said recess portions crossing a ridge direction of said folded portions with a predetermined angle, and said recess portions being formed so as to cross over a plurality of said folded portions.

14. A heat exchanger according to claim 7, wherein said cooling fin includes a flat portion formed between adjacent folded portions, and a connecting portion formed between each pair of adjacent recess portions in a longitudinal direction thereof.

15. A heat exchanger according to claim 14, wherein, said flat portion is divided into two portions by said recess portion, one of which is disposed between each pair of the adjacent first tubes, the other of which is disposed between each pair of the adjacent second tubes, and said connecting portion connects each pair of two portions of said flat portion.

16. A heat exchanger according to claim 13, wherein said cooling fin includes a first projection portion projected from an end side of said adjacent first tubes facing said adjacent second tubes toward said slit-shaped recess portion and a second projection portion projected from an end side of said adjacent second tubes facing said adjacent first tubes toward said slit-shaped recess portion, a first plurality of louvers are formed on said cooling fin in a range from said adjacent first tubes to said first projection portion and a second plurality of louvers are formed in a range from said adjacent second tubes to said second projection portion continuously.

17. A heat exchanger according to claim 16, wherein a turning louver is provided among one of said first and second plurality of louvers for turning a fluid flowing outside of said tubes, and a number of said louvers is different between both sides of said turning louver.

18. A heat exchanger according to claim 17, wherein a central axis of said turning louver is off set to a central axis of a respective one of said adjacent first and second tubes in its cross sectional longitudinal direction.

19. A heat exchanger according to claim 16, wherein a turning louver is provided in said projection portion for turning a fluid flowing outside of said tubes.

20. A heat exchanger according to claim 16, wherein said first tubes are used for condenser tubes of a condenser core portion for condensing a refrigerant of a condenser for forming a refrigerant cycle, said second tubes are used for radiator tubes of a radiator core portion of a radiator for cooling an automotive engine, and said condenser core portion is disposed at an upstream air side of said radiator core portion.

21. An automotive heat exchanger for cooling an engine water for cooling an engine and a refrigerant of an air conditioning apparatus employing a refrigeration cycle, said automotive heat exchanger disposed at a front side of the vehicle and comprising:

a plurality of first tubes in which said refrigerant flows;

a first core portion including a corrugated first cooling fin disposed between adjacent first tubes;

a plurality of second tubes in which said engine water flows, said second tubes being disposed at a downstream air side of said first core portion in parallel with said first tubes so as to form a predetermined clearance therewith;

a second core portion including a corrugated second cooling fin disposed between adjacent second tubes;

a plurality of connecting portions for partially connecting said first cooling fin;

a plurality of clearances disposed between said corrugated first cooling fin and said corrugated second cooling fin, said plurality of clearances being formed by said plurality of connecting portions;

a partition member disposed at end portions of said first core portion and second core portion, for preventing the air bypassing said first core portion from flowing through said clearance between said first cooling fin and said second cool fin;

wherein at least two of said folded portions of said first and second cooling fins are formed between adjacent connecting portions.

22. An automotive heat exchanger according to claim 21, wherein said partition member is formed by a side plate which is a reinforcing member of said first core portion and said second core portion.

23. An automotive heat exchanger according to claim 21, wherein an end portion of said first cooling fin placed at said second tube side is deviated along a right direction from said first tube to said second tube in a range of −1.5 to 7.0 mm from a standard position where an end portion of said first tube is placed at said second tube side.

24. An automotive heat exchanger according to claim 21, wherein, said second cooling fin is projected from said second tube toward said first tube side with a projection length being equal to 8.0 mm or less.

25. An automotive heat exchanger according to claim 11, wherein said connecting portions has a portion in parallel with a longitudinal direction of said first and second cooling fins, a length of said portion being less than 5% of a length between each pair of the adjacent said connecting portions when said first and second cooling fins are unfolded.

26. An automotive heat exchanger according to claim 11, wherein said connecting portions has a portion in parallel with a longitudinal direction of said first and second cooling fins, a length of said portion being less than 10% of a length between each pair of the adjacent said connecting portions when said first and second cooling fins are unfolded.

27. An automotive heat exchanger according to claim 21, wherein said corrugated first cooling fin includes a first projection portion projected from said adjacent first tubes toward said adjacent second tubes, said corrugated second cooling fin includes a second projection portion projected from said adjacent second tubes toward said adjacent first tubes, a first plurality of louvers are formed on said corrugated first cooling fin in a range from said adjacent first tubes to said first projection portion continuously, and a second plurality of louvers are formed on said corrugated second cooling fin in a range from said adjacent second tubes to said second projection portion continuously.

28. An automotive heat exchanger according to claim 27, wherein a turning louver is provided among one of said first and second plurality of louvers for turning a fluid flowing outside of said tubes, and a number of said louvers is different between both sides of said turning louver.

29. A heat exchanger according to claim 28, wherein a central axis of said turning louver is off set to a central axis of a respective one of said adjacent first and second tubes in its cross sectional longitudinal direction.

30. A heat exchanger according to claim 27, wherein a turning louver is provided in said projection portion for turning a fluid flowing outside of said tubes.

31. A heat exchanger according to claim 27, wherein said first tubes are used for condenser tubes of a condenser core portion for condensing a refrigerant of a condenser for forming a refrigerant cycle, said second tubes are used for radiator tubes of a radiator core portion of a radiator for cooling an automotive engine, and said condenser core portion is disposed at an upstream air side of said radiator core portion.

32. A heat exchanger according to claim 21, wherein said plurality of connecting portions have a slit for reducing an amount of heat transfer between said corrugated first cooling fin and said corrugated second cooling fin.

33. An automotive heat exchanger for cooling an engine water for cooling an engine and a refrigerant of an air conditioning apparatus employing a refrigeration cycle, said automotive heat exchanger disposed at a front side of the vehicle and comprising:

a plurality of first tubes in which said refrigerant flows;

a first core portion including a corrugated first cooling fin disposed between adjacent first tubes;

a plurality of second tubes in which said engine water flows, said second tubes being disposed at a downstream air side of said first core portion in parallel with said first tubes so as to form a predetermined clearance therewith;

a second core portion including a corrugated second cooling fin disposed between adjacent second tubes; and a plurality of connecting portions for partially connecting said first cooling fin and said second cooling fin;

a plurality of clearances disposed between said corrugated first cooling fin and said corrugated second cooling fin, said plurality of clearances being formed by said plurality of connecting portions;

wherein at least two of said folded portions of said first and second cooling fins are formed between adjacent connecting portions;

wherein said clearance between said first cooling fin and said second cooling fin has a distance (Ls) being equal to 5.0 mm or less.

34. An automotive heat exchanger according to claim 33, wherein an end portion of said first cooling fin placed at said second tube side is deviated along a right direction from said first tube to said second tube in a range of −1.5 to 7.0 mm from a standard position where an end portion of said first tube is placed at said second tube side.

35. An automotive heat exchanger according to claim 33, wherein said corrugated first cooling fin includes a first projection portion projected from said adjacent first tubes toward said adjacent second tubes, said corrugated second cooling fin includes a second projection portion projected from said adjacent second tubes toward said adjacent first tubes, a first plurality of louvers are formed on said corrugated first cooling fin in a range from said adjacent first tubes to said first projection portion continuously, and a second plurality of louvers are formed on said corrugated second cooling fin in a range from said adjacent second tubes to said second projection portion continuously.

36. An automotive heat exchanger according to claim 35, wherein a turning louver is provided among one of said first and second plurality of louvers for turning a fluid flowing outside of said tubes, and a number of said louvers is different between both sides of said turning louver.

37. An automotive heat exchanger according to claim 36, wherein a central axis of said turning louver is off set to a central axis of a respective one of said adjacent first and second tubes in its cross sectional longitudinal direction.

38. An automotive heat exchanger according to claim 35, wherein a turning louver is provided in said projection portion for turning a fluid flowing outside of said tubes.

39. An automotive heat exchanger according to claim 35, wherein said first tubes are used for condenser tubes of a condenser core portion for condensing a refrigerant of a condenser for forming a refrigerant cycle, said second tubes are used for radiator tubes of a radiator core portion of a radiator for cooling an automotive engine, and said condenser core portion is disposed at an upstream air side of said radiator core portion.

40. An automotive heat exchanger according to claim 33, wherein said plurality of connecting portions have a slit for reducing an amount of heat transfer between said corrugated first cooling fin and said corrugated second cooling fin.

41. A heat exchanger comprising:

a plurality of first tubes in which a first refrigerant flows;

a corrugated first cooling fin in which a plurality of folded portions is formed continuously, said corrugated first cooling fin being disposed between adjacent first tubes;

a plurality of second tubes in which a second refrigerant flows, said second tubes being disposed in parallel with said first tubes;

a corrugated second cooling fin in which a plurality of folded portions is formed continuously, said corrugated second cooling fin being disposed between adjacent second tubes; and a plurality of connecting portions for connecting a side end portion facing the adjacent second cooling fin of said first cooling fin and a side end portion facing the adjacent first cooling fin of said second cooling fin so as to have a predetermined clearance therebetween, wherein at least two of said folded portions of said first and second cooling fins are formed, between adjacent connecting portions;

said corrugated first cooling fin includes a first projection portion projected form said first tubes toward said second tubes;

said corrugated second cooling fin includes a second projection portion projected from said second tubes toward said first tubes, a first plurality of louvers are formed on said corrugated first cooling fin in a range from said adjacent first tubes to said first projection portion continuously, a second plurality of louvers are formed on said corrugated second cooling fin in a range from said adjacent second tubes to said second projection portion continuously;

a turning louver is provided among one of said first and second plurality of louvers for turning a fluid flowing outside of said tubes, a number of said louvers is different between both sides of said turning louver;

wherein a central axis of said turning louver is off set to a central axis of a respective one of said adjacent first and second tubes in its cross sectional longitudinal direction.

42. An automotive heat exchanger for cooling an engine water for cooling an engine and a refrigerant of an air conditioning apparatus employing a refrigeration cycle, said automotive heat exchanger disposed at a front side of the vehicle and comprising:

a plurality of first tubes in which said refrigerant flows;

a first core portion including a corrugated first cooling fin disposed between adjacent first tubes;

a plurality of second tubes in which said engine water flows, said second tubes being disposed at a downstream air side of said first core portion in parallel with said first tubes so as to form a predetermined clearance therewith;

a second core portion including a corrugated second cooling fin disposed between adjacent second tubes;

a plurality of connecting portions for partially connecting said first cooling fin so as to have a predetermined clearance therebetween;

a partition member disposed at end portions of said first core portion and second core portion for preventing the air bypassing said first core portion from flowing through said clearance between said first cooling fin and said second cooling fin; wherein, said corrugated first cooling fin includes a first projection portion projected from said first tubes toward said second tubes, said corrugated second cooling fin includes a second projection portion projected from said second tubes toward said first tubes, a first plurality of louvers are formed on said corrugated first cooling fin in a range from said adjacent first tubes to said first projection portion continuously, a second plurality of louvers are formed on said corrugated second cooling fin in a range from said adjacent second tubes to said projection portion continuously, a turning louver is provided among one of said first and second plurality of louvers for turning a fluid flowing outside of said tubes, a number of said louvers is different between both sides of said turning louver;

wherein a central axis of said turning louver is off set to a central axis of a respective one of said adjacent first and second tubes in its cross sectional longitudinal direction.

43. An automotive heat exchanger for cooling an engine water for cooling an engine and a refrigerant of an air conditioning apparatus employing a refrigeration cycle, said automotive heat exchanger disposed at a front side of the vehicle and comprising:

a plurality of first tubes in which said refrigerant flows;

a first core portion including a corrugated first cooling fin disposed between adjacent first tubes;

a plurality of second tubes in which said engine water flows, said second tubes being disposed at a downstream air side of said first core portion in parallel with said first tubes so as to form a predetermined clearance therewith;

a second core portion including a corrugated second cooling fin disposed between adjacent second tubes;

a plurality of connecting portions for partially connecting said first cooling fin and said second cooling fin so as to have a predetermined clearance therebetween;

wherein said clearance between said first cooling fin and said second cooling fin has a distance (Ls) being equal to 5.0 mm or less; wherein, said corrugated first cooling fin includes a first projection portion projected from said first tubes toward said second tubes;

said corrugated second cooling fin includes a second projection portion projected from said second tubes toward said first tubes;

a first plurality of louvers are formed on said corrugated first cooling fin in a range from said adjacent first tubes to said first projection portion continuously;

a second plurality of louvers are formed on said corrugated second cooling fin in a range from said adjacent second tubes to said second projection portion continuously;

a turning louver is provided among one of said first and second plurality of louvers for tuning a fluid flowing outside of said tubes;

a number of said louvers is different between both sides of said turning louver;

wherein a central axis of said turning louver is off set to a central axis of a respective one of said adjacent first and second tubes in its cross sectional longitudinal direction.

44. A heat exchanger comprising:

a plurality of first tubes in which a first refrigerant flows;

a plurality of second tubes in which a second refrigerant flows, said second tubes being disposed in parallel with said first tubes; and a cooling fin in which a plurality of folded portions is formed continuously in a corrugated shape, said cooling fin being disposed between adjacent first tubes and adjacent second tubes, wherein said cooling fin includes a plurality of slit-shaped recess portions formed between said first tubes and said second tubes, a longitudinal direction of said recess portions crossing a ridge direction of said folded portions with a predetermined angle, and said recess portions being formed so as to cross over a plurality of said folded portions; and a plurality of connecting portions being formed between said plurality of slit-shaped recess portions.

45. A heat exchanger according to claim 44, wherein each of said first and second cooling fins includes a flat portion formed between adjacent folded portions, and said connecting portions are formed between each pair of said flat portion of said first cooling fin and said flat portion of said second cooling fin.

46. A heat exchanger according to claim 44, wherein said connecting portion has a portion in parallel with a longitudinal direction of said first and second cooling fins, a length of said portion being less than 5% of a length between adjacent connecting portions when said first and second cooling fins are unfolded.

47. A heat exchanger according to claim 46, wherein said first cooling fin is projected from said first tubes toward said second tubes with a projection length being in a range of 1.7 to 7.0 mm.

48. A heat exchanger according to claim 46, wherein said second cooling fin is projected from said second tubes toward said first tubes with a projection length being equal to 5.0 mm or less.

49. A heat exchanger according to claim 44, wherein said connecting portion has a portion in parallel with a longitudinal direction of said first and second cooling fins, a length of said portion being less than 10% of a length between adjacent connecting portions when said first and second cooling fins are unfolded.

50. A heat exchanger according to claim 44, wherein, said first tubes are used for condenser tubes of a condenser core portion for condensing a refrigerant of a condenser for forming a refrigeration cycle, said second tubes are used for radiator tubes of a radiator core portion of a radiator for cooling an automotive engine, and wherein said condenser core portion is disposed at an upstream air side of said radiator core portion.

* * * * *